US012385641B1

(12) United States Patent
Li et al.

(10) Patent No.: US 12,385,641 B1
(45) Date of Patent: Aug. 12, 2025

(54) COMBUSTOR FOR A GAS TURBINE ENGINE

(71) Applicant: General Electric Company, Schenectady, NY (US)

(72) Inventors: Hejie Li, Mason, OH (US); Gerardo Antonio Salazar Lois, West Chester, OH (US); Clayton S. Cooper, Loveland, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/736,927

(22) Filed: Jun. 7, 2024

(51) Int. Cl.
*F23R 3/12* (2006.01)

(52) U.S. Cl.
CPC ..... *F23R 3/12* (2013.01)

(58) Field of Classification Search
CPC .... F23R 3/286; F23R 3/10; F23R 3/02; F23R 3/04; F23R 3/002; F23R 3/14; F23R 3/343; F23R 3/16; F23R 3/12
See application file for complete search history.

(56) References Cited

U.S. PATENT DOCUMENTS 2,893,647 A * 7/1959 Wortman ..... B05B 1/323 239/464
3,853,273 A * 12/1974 Bahr ..... F23R 3/14 239/404
4,693,074 A * 9/1987 Pidcock ..... F23C 7/02 60/746
4,712,370 A * 12/1987 MacGee ..... F02C 7/28 60/785
4,890,453 A 1/1990 Iwai et al.
6,250,062 B1 * 6/2001 Lawen, Jr. ..... F23R 3/283 29/455.1
6,772,594 B2 * 8/2004 Nishida ..... F23R 3/343 60/737
6,915,637 B2 7/2005 Nishida et al.
(Continued)

FOREIGN PATENT DOCUMENTS

CN 113606608 B 3/2023
EP 1555407 B1 4/2013
(Continued)

*Primary Examiner* — Craig Kim
(74) *Attorney, Agent, or Firm* — Venable LLP; Edward A. Kmett; Michele V. Frank

(57) ABSTRACT

A combustor for a gas turbine engine includes a dome-deflector structure and a fuel nozzle-swirler assembly having a mounting wall with a plurality of purge orifices extending therethrough. A circumferential purge cavity is defined between a fuel nozzle-swirler assembly housing, a fuel nozzle-swirler assembly opening of the dome-deflector structure, and the mounting wall. The purge orifices provide a purge airflow to the circumferential purge cavity. In a first state, when a radial height of the circumferential purge cavity is constant, the dome-deflector structure overlaps a portion of the purge orifices to block a portion of each purge orifice, and, in a second state when the fuel nozzle-swirler assembly is radially shifted, the dome-deflector structure increases blockage of at least one purge orifice on a second side of the circumferential purge cavity, and reduces blockage of at least one purge orifice on a first side of the circumferential purge cavity.

20 Claims, 10 Drawing Sheets

(56) References Cited

U.S. PATENT DOCUMENTS

| | | | | |
|---|---|---|---|---|
| 9,371,990 | B2 * | 6/2016 | Moran | F23D 11/383 |
| 10,422,535 | B2 * | 9/2019 | Knapp | F23R 3/34 |
| 10,495,312 | B2 * | 12/2019 | Rodrigues | F23R 3/14 |
| 10,920,986 | B2 * | 2/2021 | Tsunoda | F23R 3/10 |
| 11,391,461 | B2 * | 7/2022 | Ichihashi | F23R 3/10 |
| 2017/0276356 | A1 * | 9/2017 | Mulcaire | F23R 3/002 |
| 2018/0003385 | A1 * | 1/2018 | Rodrigues | F23R 3/283 |
| 2021/0055000 | A1 * | 2/2021 | Ichihashi | F01D 25/12 |
| 2022/0282870 | A1 * | 9/2022 | Kim | F23R 3/286 |
| 2023/0053389 | A1 * | 2/2023 | Vukanti | F23R 3/16 |
| 2023/0112117 | A1 * | 4/2023 | Salazar Lois | F23R 3/007 60/722 |
| 2024/0377066 | A1 * | 11/2024 | Sharma | F23R 3/286 |

FOREIGN PATENT DOCUMENTS

| | | | |
|---|---|---|---|
| EP | 2491310 | B1 | 7/2015 |
| EP | 3421761 | B1 | 11/2020 |
| EP | 3563090 | B1 | 11/2020 |
| WO | 2015/043735 | A1 | 4/2015 |

* cited by examiner

COMBUSTOR FOR A GAS TURBINE ENGINE

TECHNICAL FIELD

The present disclosure relates to a combustor for a gas turbine engine.

BACKGROUND

Gas turbine engines include a combustor. The combustor generally includes a dome structure that is connected to a liner to define a combustion chamber. A plurality of fuel nozzle/swirler assemblies are mounted to the dome structure and provide a fuel/air mixture into the combustion chamber. The fuel/air mixture is ignited and burned within the combustion chamber to generate combustion gases. The dome structure may include a heat shield to protect the dome structure from the hot gases generated in the combustion chamber. The heat shield may also include cooling holes to allow compressed air to flow therethrough to provide cooling to the hot side of the heat shield.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
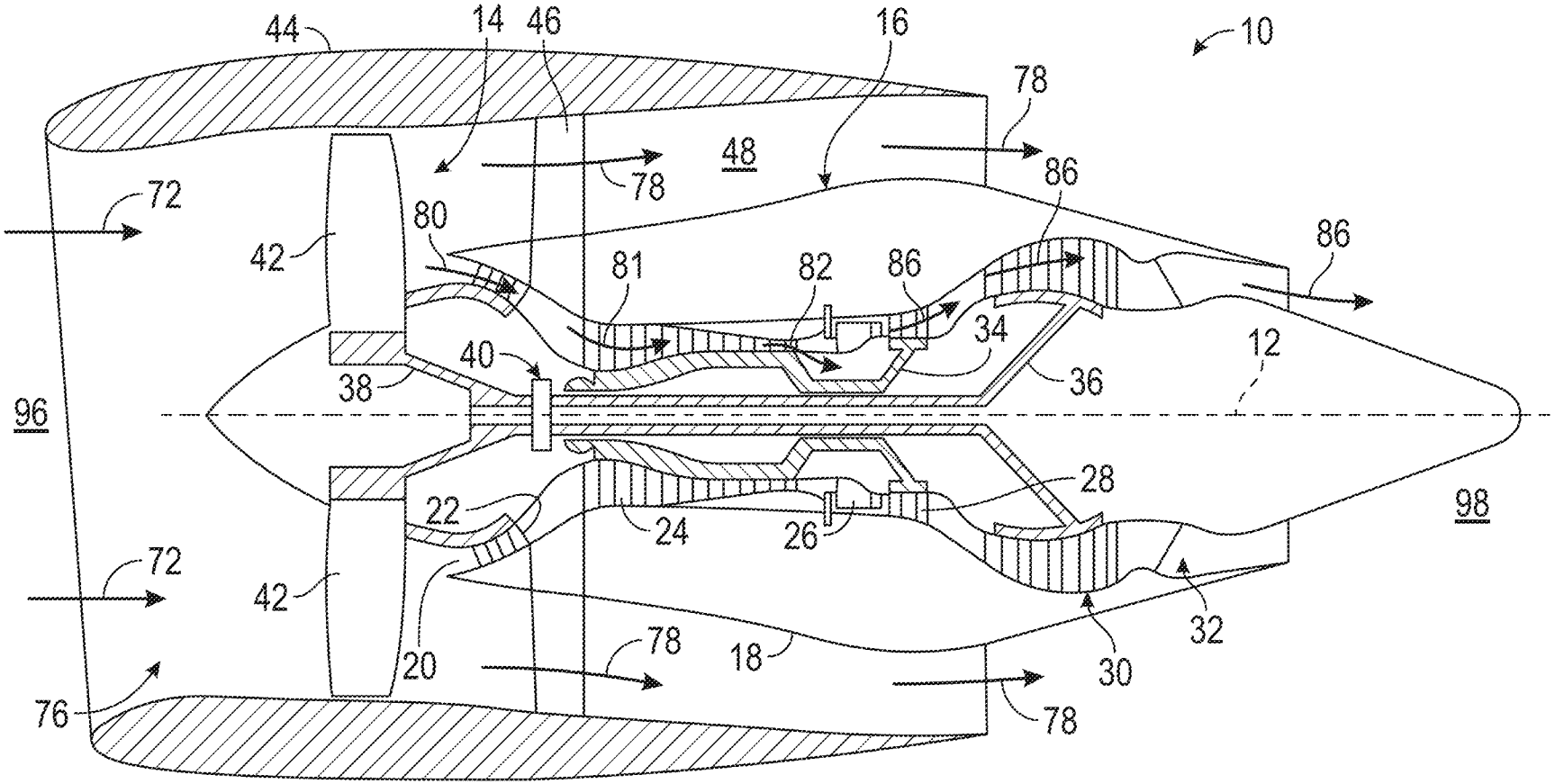
FIG. 1 is a schematic cross-sectional side view of an exemplary high by-pass turbofan jet engine, according to an aspect of the present disclosure.

Features, advantages, and embodiments of the present disclosure are set forth or apparent from a consideration of the following detailed description, drawings, and claims. Moreover, the following detailed description is exemplary and intended to provide further explanation without limiting the disclosure as claimed.

Various embodiments are discussed in detail below. While specific embodiments are discussed, this is done for illustration purposes only. A person skilled in the relevant art will recognize that other components and configurations may be used without departing from the present disclosure.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "forward" and "aft" refer to a relative side of an element and may be used interchangeably with the terms "upstream" and "downstream," respectively.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

The singular forms "a," "an," and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially" is not to be limited to the precise value specified. In at least some instances, the approximating language may correspond to the precision of an instrument for measuring the value, or the precision of the methods or the machines for constructing or manufacturing the components and/or systems. For example, the approximating language may refer to being within a one, two, four, ten, fifteen, or twenty percent margin in either individual values, range(s) of values, and/or end-points defining range(s) of values.

Gas turbine engines include a combustor. The combustor generally includes a dome structure that is connected to a liner to define a combustion chamber. A plurality of fuel nozzle/swirler assemblies are mounted to the dome structure and provide a fuel/air mixture into the combustion chamber. The fuel/air mixture is ignited and burned within the combustion chamber to generate combustion gases. The dome structure may include a heat shield to protect the dome structure from the hot gases generated in the combustion chamber. The heat shield may also include cooling holes to allow compressed air to flow therethrough to provide cooling to the hot side of the heat shield. The fuel nozzle/swirler assembly is mounted to the dome structure with a circumferential gap between the swirler and the dome-deflector structure, and a flow of purge cooling air is provided to the circumferential gap via cooling holes. The circumferential gap allows for radial shifting of the fuel nozzle/swirler assembly with respect to the dome structure. With the foregoing structure, however, when the fuel nozzle/swirler assembly shifts radially, a larger gap occurs in at least part of the circumferential gap, which increases the risk for hot combustion gases from the combustion chamber to be ingested into the larger gap. The ingestion of the hot combustion gases into the gap can cause thermal distress of the swirler, as well as to the dome-deflector structure.

The present disclosure provides a technique to increase the purge air flow locally within the circumferential gap when shifting of the fuel nozzle/swirler assembly occurs. According to the present disclosure, purge orifices provide a purge airflow to the circumferential gap between the swirler and the dome structure. In a first state, when the radial height of the circumferential gap is constant, the dome-deflector structure blocks a portion of each of the plurality of purge orifices. In a second state, when the fuel nozzle-swirler assembly shifts radially to result in a larger gap on one side and a smaller gap on the other side, some of the purge orifices on the smaller gap side are further blocked, while some of the purge orifices on the larger gap side are unblocked to provide additional purge airflow to the larger gap side. As a result, localized ingestion of hot combustion gases into the larger gap side can be prevented by providing the additional purge airflow. The total purge airflow for the circumferential gap remains the same for the first state and second state.

Referring now to the drawings, FIG. 1 is a schematic cross-sectional side view of an exemplary high by-pass turbofan jet engine 10, herein referred to as "engine 10," as may incorporate various embodiments of the present disclosure. Although further described below with reference to a ducted turbofan engine, the present disclosure is also applicable to turbomachinery in general, including turbojet, turboprop, and turboshaft gas turbine engines, including marine and industrial turbine engines and auxiliary power units. In addition, the present disclosure is not limited to ducted fan type turbine engines such as that shown in FIG. 1, but can be implemented in unducted fan (UDF) type turbine engines as well. As shown in FIG. 1, engine 10 has a longitudinal centerline axis 12 that extends therethrough from an upstream end 96 of the engine 10 to a downstream end 98 of the engine 10 for reference purposes. In general, engine 10 may include a fan assembly 14 and a turbo-engine 16 disposed downstream from the fan assembly 14.

The turbo-engine 16 may generally include an outer casing 18 that defines an annular inlet 20 to the turbo-engine 16. The outer casing 18 encases, or at least partially forms, in serial flow relationship, a compressor section that includes a booster or a low-pressure compressor (LPC) 22 and a high-pressure compressor (HPC) 24, a combustor 26, a turbine section that includes a high-pressure turbine (HPT) 28 and a low-pressure turbine (LPT) 30, and a jet exhaust nozzle 32. A high-pressure rotor shaft 34 drivingly connects the HPT 28 to the HPC 24. A low-pressure rotor shaft 36 drivingly connects the LPT 30 to the LPC 22. The low-pressure rotor shaft 36 may also be connected to a fan shaft 38 of the fan assembly 14. In particular embodiments, as shown in FIG. 1, the low-pressure rotor shaft 36 may be connected to the fan shaft 38 by way of a reduction gearbox assembly 40, such as in an indirect-drive or a geared-drive configuration. In other embodiments, although not illustrated, the engine 10 may further include an intermediate-pressure compressor and an intermediate-pressure turbine rotatable with an intermediate-pressure shaft that connects the intermediate-pressure turbine and the intermediate-pressure compressor.

As shown in FIG. 1, the fan assembly 14 includes a plurality of fan blades 42 that are coupled to, and extend radially outwardly from, the fan shaft 38. An annular fan casing or a nacelle 44 circumferentially surrounds the fan assembly 14 and/or at least a portion of the turbo-engine 16. The nacelle 44 may be supported relative to the turbo-engine 16 by a plurality of circumferentially spaced outlet guide vanes or struts 46. Moreover, at least a portion of the nacelle 44 may extend over an outer portion of the turbo-engine 16 so as to define a bypass airflow passage 48 between the nacelle 44 and the outer casing 18.

Figure 2:
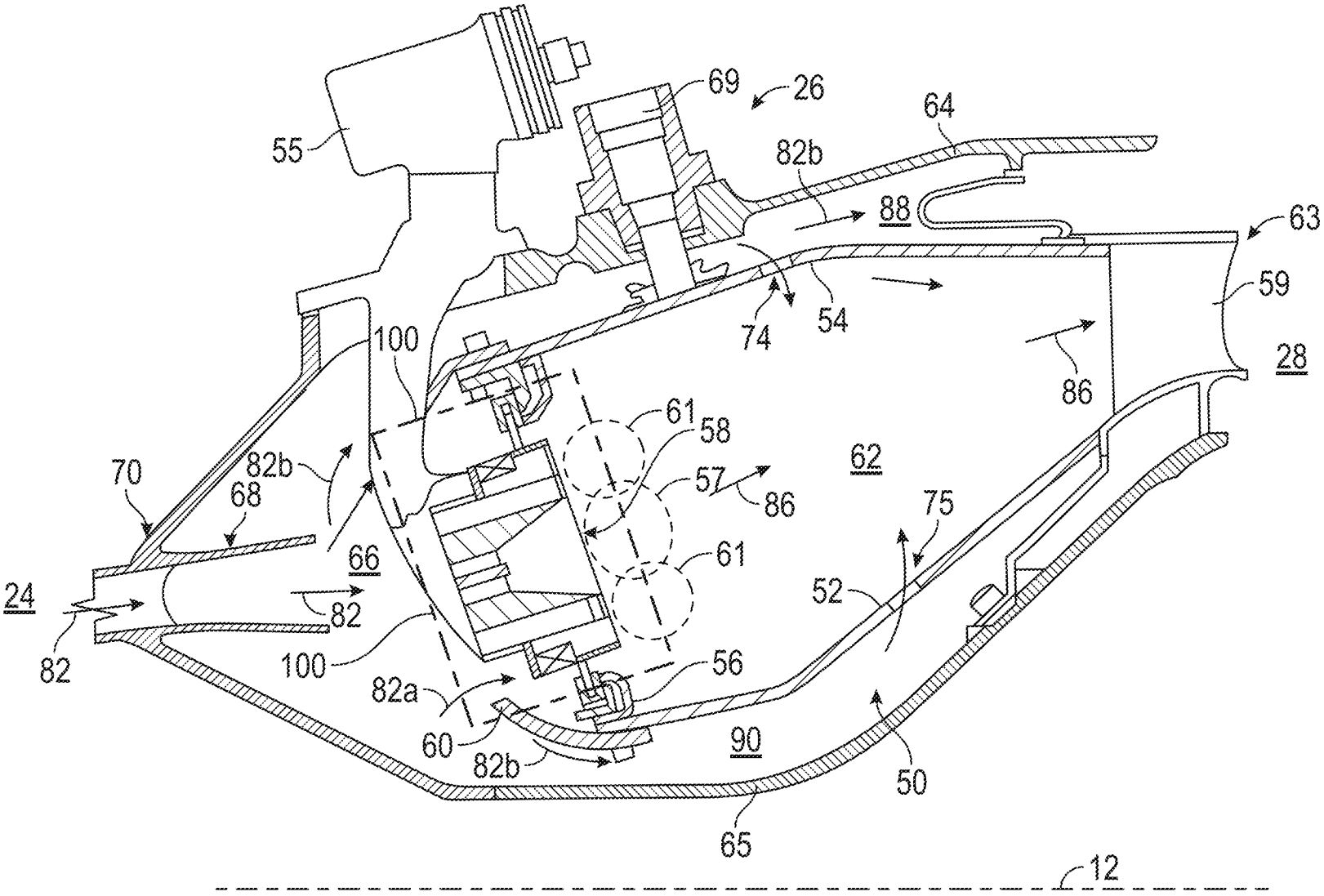
FIG. 2 is a partial cross-sectional side view of an exemplary combustor, according to an aspect of the present disclosure.

FIG. 2 is a partial cross-sectional side view of the exemplary combustor 26 of the turbo-engine 16 as shown in FIG. 1. FIG. 2 depicts an example of a twin annular pre-mixing swirler (TAPS) type combustor, but the present disclosure can be implemented with other types of combustors as well. The combustor 26 is generally an annular combustor that extends circumferentially about the longitudinal centerline axis 12. The combustor 26 includes a cowl 60, and a combustor liner 50, having an inner liner 52 and an outer liner 54. Each of the inner liner 52 and the outer liner 54 is an annular liner that extends circumferentially about the longitudinal centerline axis 12. A dome-deflector structure 56 extends between the inner liner 52 and the outer liner 54. The inner liner 52, the outer liner 54, and the dome-deflector structure 56 together define a combustion chamber 62.

The combustor 26 further includes an outer casing 64 that extends circumferentially about the longitudinal centerline axis 12, and an inner casing 65 that also extends circumferentially about the longitudinal centerline axis 12. An outer flow passage 88 is defined between the outer casing 64 and the outer liner 54, and an inner flow passage 90 is defined between the inner casing 65 and the inner liner 52. The outer casing 64 and the inner casing 65 converge at an upstream end 70 of the combustor 26, and, together, define a pressure plenum 66. The outer casing 64 and the inner casing 65 are also connected with a diffuser 68. The diffuser 68 is in flow communication with the HPC 24 to receive a flow of compressed air 82 from the HPC 24 and to provide the flow of the compressed air 82 into the pressure plenum 66.

A fuel nozzle assembly 55 is connected to the outer casing 64 and includes a fuel nozzle-swirler assembly 58, which is described in more detail below. An ignitor 69 is connected to the outer casing 64, and extends through the outer flow passage 88 and through the outer liner 54. The ignitor 69 provides an ignition source (e.g., a spark) to ignite a pilot fuel-air mixture 57. A main fuel-air mixture 61 may be ignited via the ignited pilot fuel-air mixture 57, or the ignitor 69 may also be used to ignite the main fuel-air mixture 61. In the combustion chamber 62, an initial chemical reaction of the ignited pilot fuel-air mixture 57 injected into the combustion chamber 62 by a pilot swirler portion (to be described below) of the fuel nozzle-swirler assembly 58 may occur to generate combustion gases 86. In higher power operations of the combustor 26, the main fuel-air mixture 61 is injected into the combustion chamber 62 by a main swirler portion (to be described below) of the fuel nozzle-swirler assembly 58 to generate combustion gases 86. The combustion gases 86 then flow further downstream into the HPT 28 and the LPT 30 (FIG. 1) via a turbine nozzle 59 at a downstream end 63 of the combustion chamber 62.

Referring back to FIG. 1, in operation of the engine 10, a volume of inlet air 72 enters the nacelle 44 at a nacelle inlet 76, and the inlet air 72 is propelled through the fan assembly 14. A portion of the inlet air 72 propelled by the fan assembly 14 enters the LPC 22 at the annular inlet 20 as a compressor inlet airflow 80, where the compressor inlet airflow 80 is compressed by the LPC 22 to generate compressed air 81. The compressed air 81 then flows to the HPC 24, where the compressed air 81 is further compressed to generate the compressed air 82. The compressed air 82 from the HPC 24 enters the combustor 26 via the diffuser 68 (FIG. 2). Another portion of the inlet air 72 propelled by the fan assembly 14 flows through the bypass airflow passage 48, thereby providing a bypass airflow 78. The bypass airflow 78 provides a majority of the thrust for the engine 10.

Referring back to FIG. 2, as discussed above, the compressed air 82 flows through the diffuser 68, which provides for a reduction in velocity of the compressed air 82 entering the pressure plenum 66, and increases the pressure of the compressed air 82 within the pressure plenum 66. A portion of the compressed air 82 in the pressure plenum 66 enters the cowl 60 (shown schematically as compressed air 82*a*), while another portion of the compressed air 82 passes to the outer flow passage 88 and to the inner flow passage 90 (shown schematically as compressed air 82*b*). The compressed air 82*a* passes through the fuel nozzle-swirler assembly 58 to mix with a pilot fuel flow to generate the pilot fuel-air mixture 57, and to mix with a main fuel flow to generate the main fuel-air mixture 61, both of which are then ignited to generate the combustion gases 86. The compressed air 82*b* in the outer flow passage 88 and in the inner flow passage 90 may be used for various purposes, such as dilution air flowing through dilution openings 74 though the outer liner 54, and flowing through dilution openings 75 through the inner liner 52.

Referring back to FIG. 1, the combustion gases 86 flow from the combustor 26 to the HPT 28, where work is extracted from the combustion gases 86 to rotate the HPT 28. The rotation of the HPT 28 supports rotation of the HPC 24 via the high-pressure rotor shaft 34. The combustion gases 86 then continue to flow downstream of the HPT 28 to the LPT 30, where additional work is extracted from the combustion gases 86 to rotate the LPT 30. The rotation of the LPT 30 supports rotation of the LPC 22 via the low-pressure rotor shaft 36, and also supports rotation of the fan assembly 14 via the fan shaft 38 connected to the reduction gearbox assembly 40. The remaining combustion gases 86 pass through the jet exhaust nozzle 32 and provide turbo-engine thrust.

Figure 3:
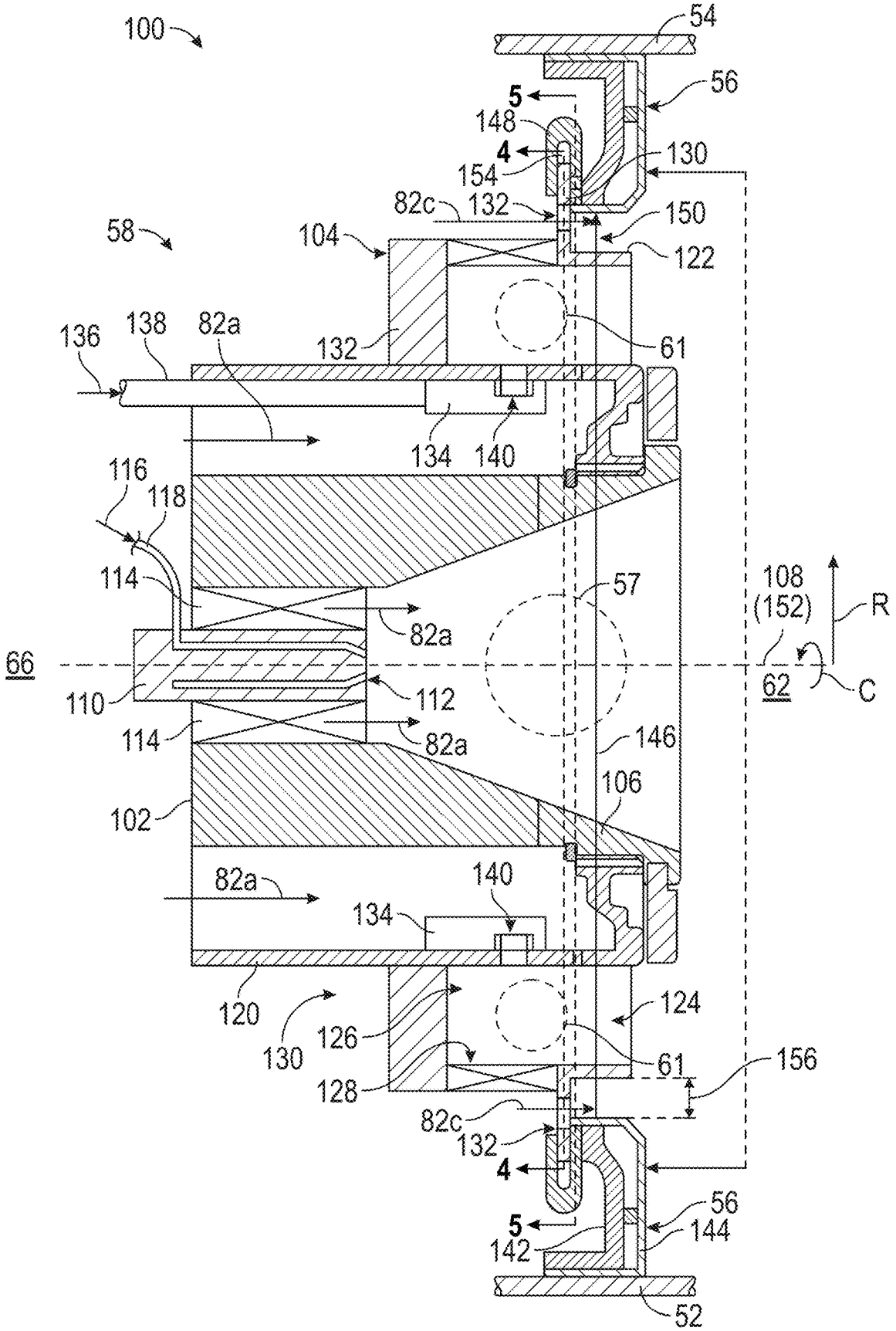
FIG. 3 is an enlarged partial cross-sectional view of a fuel nozzle-swirler assembly and dome-deflector structure, taken at detail view 100 of FIG. 2, according to an aspect of the present disclosure.

FIG. 3 is an enlarged partial cross-sectional view of the fuel nozzle-swirler assembly 58 and a portion of dome-deflector structure 56, taken at detail view 100 of FIG. 2, according to an aspect of the present disclosure. The fuel nozzle-swirler assembly 58 may generally be a twin annular premixing swirler (TAPS) fuel nozzle assembly that includes a pilot mixer 102 and a main mixer 104. The pilot mixer 102 includes a venturi 106 that extends circumferentially about a fuel nozzle centerline axis 108, and a pilot fuel injector 110 mounted within the venturi 106. Further, the pilot mixer 102 includes a pilot swirler 112 that constitutes a plurality of pilot swirl vanes 114 arranged radially outward of the pilot fuel injector 110. The pilot swirler 112 is generally oriented parallel to the fuel nozzle centerline axis 108, and includes the plurality of pilot swirl vanes 114 for swirling the compressed air 82*a* traveling therethrough. A pilot fuel flow 116 is provided via a pilot fuel line 118 to the pilot fuel injector 110. The pilot fuel flow 116 and the compressed air 82*a* are generally provided to the pilot mixer 102 during the engine operating cycle.

The pilot fuel injector 110 may be any type of fuel injector, including an air blast type of fuel injector where pre-filming and atomization of the pilot fuel flow 116 provided by the pilot fuel injector 110 is performed almost exclusively by blasting the compressed air 82*a* at the pilot fuel flow 116. The pilot fuel flow 116 is injected from the pilot fuel injector 110 into the venturi 106. The pilot fuel-air mixture 57 (FIG. 2) is then generated within the venturi 106 by mixing the swirling compressed air 82*a* passing through the pilot swirl vanes 114 and the pilot fuel flow 116 injected by the pilot fuel injector 110. The pilot fuel-air mixture 57 is then injected into the combustion chamber 62, where the pilot fuel-air mixture 57 is ignited and burned to generate the combustion gases 86.

The main mixer 104 is attached to a fuel nozzle housing 120 that surrounds the pilot mixer 102. The main mixer 104 includes an annular main swirler housing 122 radially surrounding the fuel nozzle housing 120, where the main swirler housing 122 defines an annular cavity 124. The main mixer 104 includes a radial swirler 126 that is oriented substantially radially to the fuel nozzle centerline axis 108, and includes a plurality of radial swirl vanes 128 (shown generally) for swirling the compressed air 82*a* flowing therebetween. The radial swirl vanes 128 are substantially uniformly spaced circumferentially, and a plurality of substantially uniform passages are defined between adjacent radial swirl vanes 128.

A main fuel circuit 134 is located within the fuel nozzle housing 120 between the pilot mixer 102 and the main mixer 104. The main fuel circuit 134 is provided with a main fuel flow 136 via a main fuel line 138. A plurality of main fuel injectors 140 are provided at the main fuel circuit 134, and are arranged to inject the main fuel flow 136 into the annular cavity 124 of the main mixer 104. The main fuel-air mixture 61 (FIG. 2) is generated within the annular cavity 124 by mixing of the compressed air 82*a* passing through the radial swirl vanes 128 with the main fuel flow 136 injected by the main fuel injectors 140 into the annular cavity 124. The main fuel-air mixture 61 then flows into the combustion chamber 62, where the main fuel-air mixture 61 is ignited and burned to generate the combustion gases 86.

The main swirler housing 122 includes a mounting wall 130 for mounting the fuel nozzle-swirler assembly 58 to the dome-deflector structure 56. The mounting wall 130 extends in a radial direction (R) with respect to the fuel nozzle centerline axis 108 from the main swirler housing 122, and also extends circumferentially about the fuel nozzle centerline axis 108. The mounting wall 130 includes a plurality of purge orifices 132 extending through the mounting wall 130. As will be described in more detail below, the plurality of purge orifices 132 are arranged to provide a purge airflow 82*c* therethrough. As will be described in more detail below, the plurality of purge orifices 132 are circumferentially spaced apart from each other about the fuel nozzle centerline axis 108.

The dome-deflector structure 56 includes a dome 142 and a deflector 144 that are connected together. The deflector 144 functions as a heat shield and protects the dome 142 from the hot combustion gases 86 generated in the combustion chamber 62. The dome-deflector structure 56 includes a fuel nozzle-swirler assembly opening 146 therethrough. The fuel nozzle-swirler assembly opening 146 is generally a circular shaped opening that defines an opening centerline axis 152. In FIG. 3, the fuel nozzle centerline axis 108 and the opening centerline axis 152 are shown to be congruent with each other. Here, congruent is intended to mean that the fuel nozzle centerline axis 108 and the opening centerline axis 152 coincide with one another when superimposed on one another such that they form a same single centerline axis. The fuel nozzle-swirler assembly 58, when mounted to the dome-deflector structure 56, extends through the fuel nozzle-swirler assembly opening 146. A mounting member 148 is connected to the dome-deflector structure 56 (e.g., connected via brazing), and is provided for mounting the fuel nozzle-swirler assembly 58 to the dome-deflector structure 56. The mounting wall 130 slidingly engages within a cavity 154 of the mounting member 148 to allow radial motion of the fuel nozzle-swirler assembly 58 with respect to the fuel nozzle-swirler assembly opening 146. The fuel nozzle-swirler assembly 58 can move in any radial and circumferential direction with respect to the opening centerline axis 152 such that the fuel nozzle centerline axis 108 and the opening centerline axis 152 are radially offset from one another in the direction of the radial movement. When the fuel nozzle-swirler assembly 58 is mounted to the dome-deflector structure 56, a circumferential purge cavity 150 is defined between the main swirler housing 122, the fuel nozzle-swirler assembly opening 146 of the dome-deflector structure 56, and the mounting wall 130. The plurality of purge orifices 132 are arranged to provide the purge airflow 82*c* to the circumferential purge cavity 150. As will be described in more detail below, when the fuel nozzle-swirler assembly 58 moves radially, a radial height 156 of the circumferential purge cavity 150 changes from being a constant height circumferentially to having different radial heights on opposing sides of the circumferential purge cavity 150.

Figure 4:
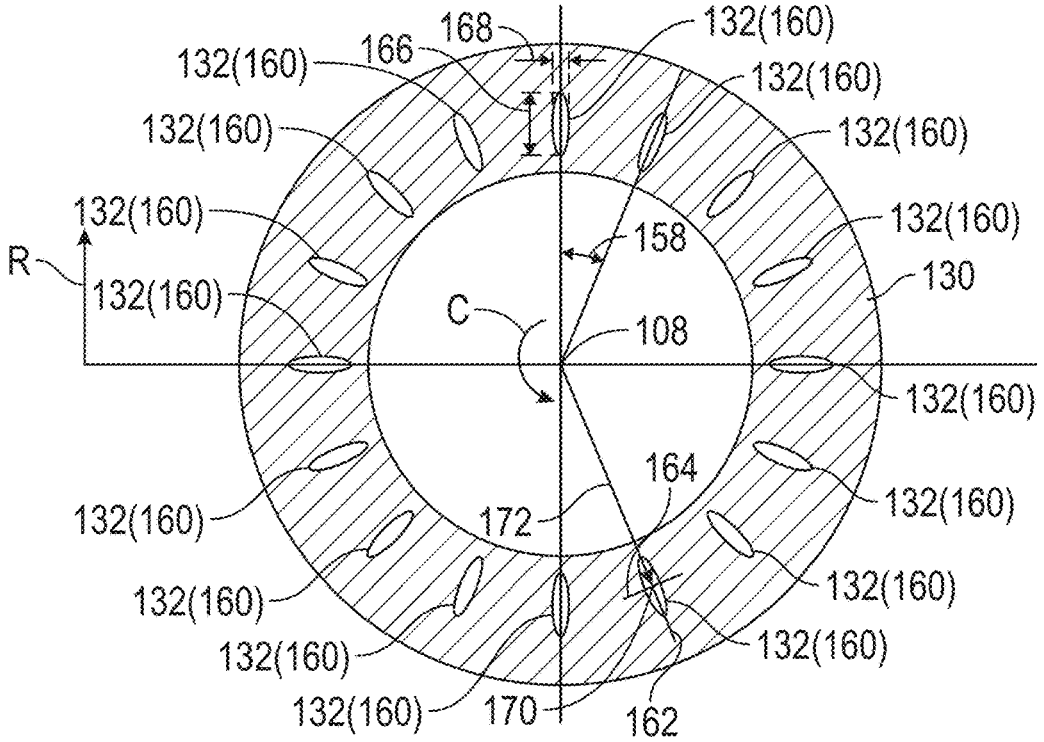
FIG. 4 is a forward-looking cross-sectional view of a fuel nozzle-swirler assembly mounting wall and purge orifices, taken at plane 4-4 of FIG. 3, according to an aspect of the present disclosure.

FIG. 4 is a forward-looking cross-sectional view of a mounting wall 130 and purge orifices 132, taken at plane 4-4 of FIG. 3, according to an aspect of the present disclosure. In FIG. 4, only the mounting wall 130 is depicted and other aspects of the fuel nozzle-swirler assembly 58 are omitted from the cross-sectional view. In FIG. 4, the plurality of purge orifices 132 are shown to be circumferentially spaced apart about the fuel nozzle centerline axis 108. Each of the plurality of purge orifices 132 may be spaced apart an angular spacing 158 from each other. Alternatively, the angular spacing 158 need not be the same between each of the plurality of purge orifices 132, and a different angular spacing 158 between a respective pair of the plurality of purge orifices 132 may be implemented instead. In the FIG. 4 aspect, each of the plurality of purge orifices 132 are shown to be an oval-shaped purge orifice 160. Each oval-shaped purge orifice 160 has a major axis 162 and a minor axis 164, and each oval-shaped purge orifice 160 is arranged with the major axis 162 extending in the radial direction (R) with respect to the fuel nozzle centerline axis 108. Each oval-shaped purge orifice 160 also has a length 166 along the major axis 162 and a height 168 along the minor axis 164. The length 166 and the height 168 is selected to provide a desired volume of the purge airflow 82*c* (FIG. 3) through the plurality of purge orifices 132. In addition, a centroid 170 of each oval-shaped purge orifice 160 is arranged at a radial distance 172 from the fuel nozzle centerline axis 108, and the radial distance 172 is selected based on a potential radial shift amount (described below) of the fuel nozzle-swirler assembly 58 (FIG. 3) so as to maintain an overall total volume of the purge airflow 82*c* through the plurality of purge orifices 132.

Figure 5:
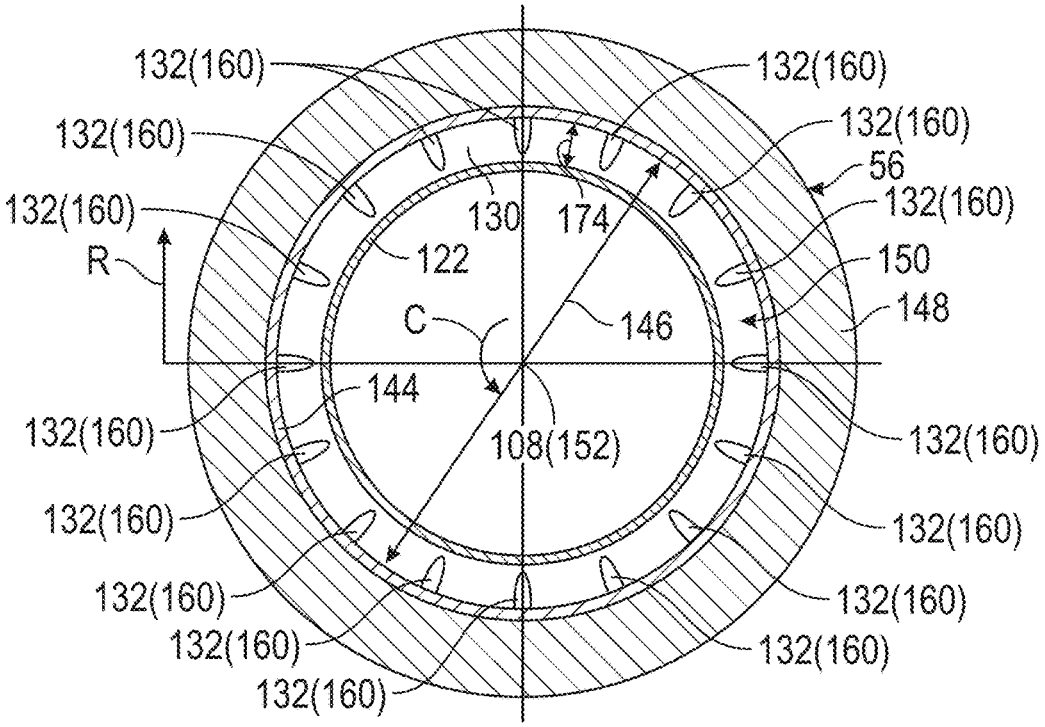
FIG. 5 is a forward-looking cross-sectional view depicting an alignment of the mounting wall of FIG. 4 with respect to the dome-deflector structure in a first state, taken at plane 5-5 of FIG. 3, according to an aspect of the present disclosure.

FIG. 5 is a forward-looking cross-sectional view depicting a first state of alignment of the mounting wall 130 of FIG. 4 with respect to the dome-deflector structure 56, taken at plane 5-5 of FIG. 3, according to an aspect of the present disclosure. In FIG. 5, similar to FIG. 4, only the mounting wall 130, the mounting member 148, and a portion of the deflector 144 are shown, and other aspects of the fuel nozzle-swirler assembly 58 are omitted from the cross-sectional view. In FIG. 5, a radial relationship in a first state of the fuel nozzle centerline axis 108 and the opening centerline axis 152 of the fuel nozzle-swirler assembly opening 146 is shown. As shown in FIG. 5, the first state may be, for example, a neutral state in which both the fuel nozzle centerline axis 108 and the opening centerline axis 152 are congruent with each other. In the first state of FIG. 5, the circumferential purge cavity 150 has a constant radial height 174. That is, the radial height 174 of the circumferential purge cavity 150 is generally substantially the same about the entire circumference of the circumferential purge cavity 150, although some very small variations (e.g., 0.005 to 0.010 mm) may exist due to manufacturing tolerances, etc. Thus, the term "constant" is intended to mean substantially the same within a very small variance amount and is not required to be exactly the same about the entire circumference. As shown in FIG. 5, in the first state, the dome-deflector structure 56 overlaps a portion of each of the plurality of purge orifices 132 so as to block a radially outward portion of each of the purge orifices 132. That is, the overlapping of the purge orifices 132 by the dome-deflector structure 56 reduces the effective airflow area of each of the purge orifices 132 through which the purge airflow 82*c* can pass through the mounting wall 130 and into the circumferential purge cavity 150. The amount of unblocked area for all of the plurality of purge orifices 132 combined provides for a total effective flow area to provide a desired total volume of the purge airflow 82*c* to the circumferential purge cavity 150. Each purge orifice 132 is sized so that, in the first state where the dome-deflector structure 56 blocks a portion of each purge orifice 132, the total purge airflow volume is obtained. The total purge airflow volume of the purge airflow 82*c* in the first state is sufficient to prevent the ingestion of hot combustion gases from the combustion chamber 62 from flowing into the circumferential purge cavity 150.

Figure 6:
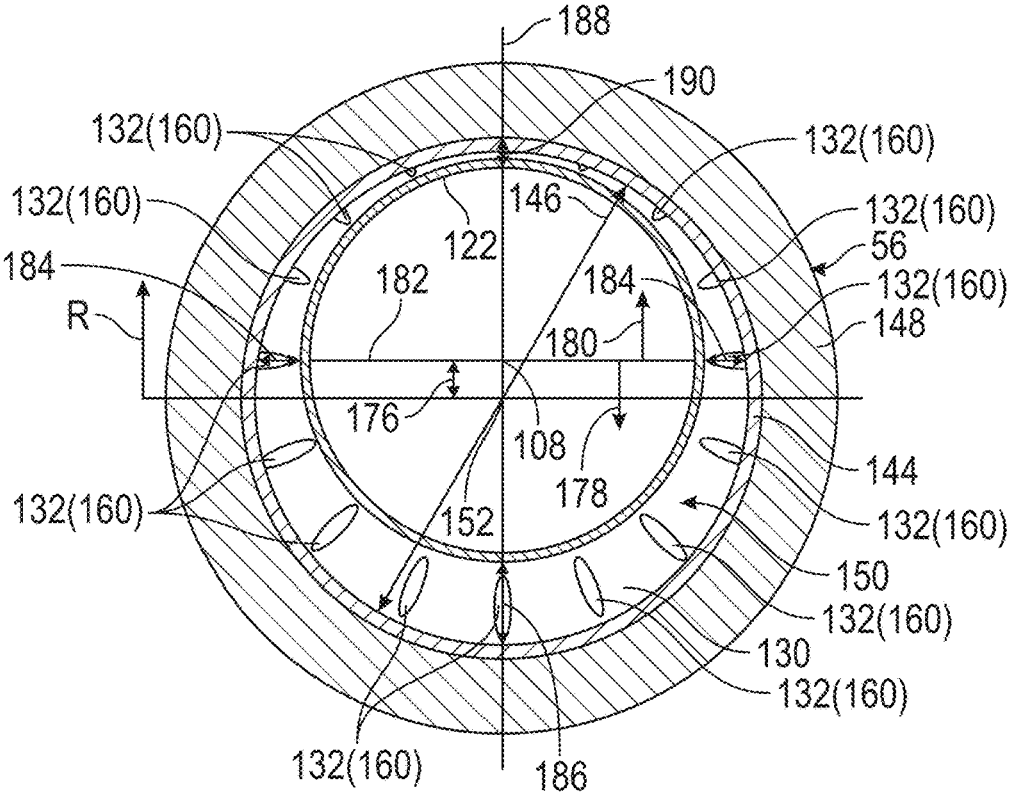
FIG. 6 is an alternate cross-sectional view to that of FIG. 5, and depicts an alignment of the mounting wall of FIG. 4 with respect to the dome-deflector structure in a second state, according to an aspect of the present disclosure.

FIG. 6 is an alternate cross-sectional view to that of FIG. 5, and depicts a second state of alignment the mounting wall 130 of FIG. 4 with respect to the dome-deflector structure 56, according to an aspect of the present disclosure. In FIG. 6, the fuel nozzle centerline axis 108 of the fuel nozzle-swirler assembly 58 (FIG. 3) is shown to be shifted in the radial direction (R) with a radial shift distance 176 such that the fuel nozzle centerline axis 108 and the opening centerline axis 152 of the fuel nozzle-swirler assembly opening 146 are no longer congruent and are radially offset from one another. FIG. 6 depicts a second state where the fuel nozzle-swirler assembly 58 has shifted radially with respect to the dome-deflector structure 56, and the radial shift distance 176 is shown as a total radial shift limit that the fuel nozzle-swirler assembly 58 can shift with respect to the dome-deflector structure 56. In the second state in which the fuel nozzle-swirler assembly 58 is radially shifted, the radial height 174 (FIG. 5) of the circumferential purge cavity 150 also shifts so that the circumferential purge cavity 150 no longer has a constant radial height 174 about the circumference of the circumferential purge cavity 150. Rather, the radial height 174 of the circumferential purge cavity 150 is increased on a first side 178 of the circumferential purge cavity 150 and the radial height 174 of the circumferential purge cavity 150 on a second side 180 of the circumferential purge cavity 150 opposing the first side 178 is decreased. The first side 178 refers to a portion of the circumferential purge cavity 150 that is on one side of a horizontal reference plane 182 through the fuel nozzle centerline axis 108, and the second side 180 refers to a portion of the circumferential purge cavity 150 that is on an opposite side of the horizontal reference plane 182. For example, on the first side 178, the radial height 174 (FIG. 5) of the circumferential purge cavity 150 increases to range from a radial height 184 at the horizontal reference plane 182 to a radial height 186 at a vertical reference plane 188. On the other hand, on the second side 180, the radial height 174 of the circumferential purge cavity 150 decreases from the radial height 184 at the horizontal reference plane 182 to a radial height 190 at the vertical reference plane 188. The increase in the radial height 174 of the circumferential purge cavity 150 to be between the radial height 184 and the radial height 186 may allow the ingestion of the hot combustion gases 86 (FIG. 2) into the increased radial height portions of the circumferential purge cavity 150, and, more particularly, adjacent to the radial height 186. The ingestion of the hot combustion gases 86 into the circumferential purge cavity 150 at the increased radial height portions can cause more rapid localized deterioration of the fuel nozzle-swirler assembly 58 and the dome-deflector structure 56.

To prevent the ingestion of the hot combustion gases 86 into the circumferential purge cavity 150, the purge orifices 132 are shaped so that, when the fuel nozzle-swirler assembly 58 shifts as shown in FIG. 6, the dome-deflector structure 56 increases blockage of at least one purge orifice on the second side 180 (e.g., on the side where the radial height 174 is decreased) such that the effective flow area as shown in FIG. 5 in the first state through the purge orifices 132 on the second side 180 is decreased, and the dome-deflector structure 56 reduces blockage of at least one purge orifice 132 on the first side 178 (e.g., on the side where the radial height 174 is increased) such that the effective flow area as shown in FIG. 5 in the first state through the purge orifices 132 on the first side 178 is increased. The increase in the effective flow area (e.g., the at least partial unblockage of the purge orifices 132 on the first side 178) provides an increase to the purge airflow volume through the purge orifices on the first side 178. The decrease in the effective flow area (e.g., the at least partial further blockage of the purge orifices 132 on the second side 180) provides a decrease in the purge airflow volume through the purge orifices 132 on the second side. However, the increase in purge flow volume through the purge orifices 132 on the first side 178 corresponds to the decrease in the purge flow volume through the purge orifices 132 on the second side 180 such that the total airflow volume through the purge orifices 132 in the second state shown in FIG. 6 is constant with the total purge airflow volume in the first state shown in FIG. 5. As a result, the increase in the purge airflow through the portion of the circumferential purge cavity 150 with the increased radial height 186 prevent the ingestion of the hot combustion gases 86 into the first side 178 of the circumferential purge cavity 150.

Figure 7:
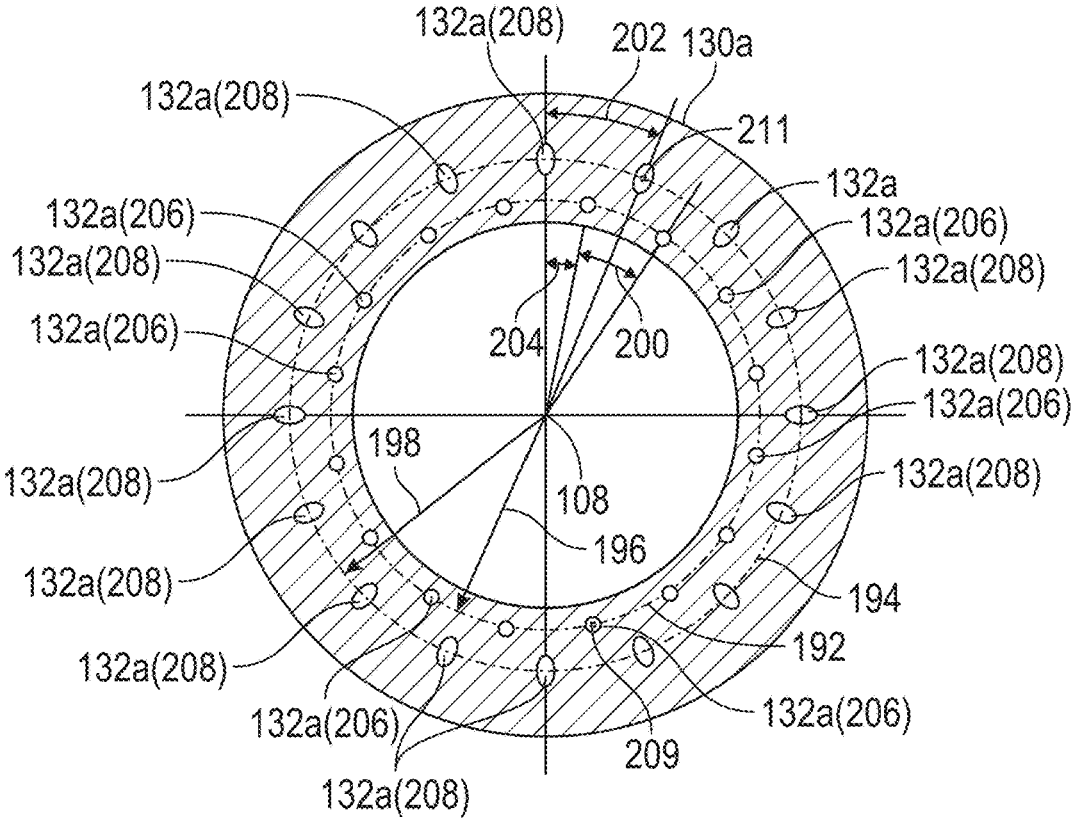
FIG. 7 depicts an alternate cross-sectional view of a fuel nozzle-swirler assembly mounting wall and purge orifices to that shown in FIG. 4, according to an aspect of the present disclosure.

FIG. 7 depicts an alternate cross-sectional view of a fuel nozzle-swirler assembly mounting wall 130*a* and purge orifices 132*a* to that shown in FIG. 4, according to an aspect of the present disclosure. Elements in FIG. 7 that are the same as those of FIG. 4 are labeled with the same reference numerals and the description above for those elements is also applicable to FIG. 7, unless stated otherwise. In FIG. 7, the plurality of purge orifices 132*a* are seen to be arranged in a plurality of circumferential rows, including a first circumferential row 192 of purge orifices 132*a* and a second circumferential row 194 of purge orifices 132*a*. The first circumferential row 192 of the purge orifices 132*a* is arranged a first radial distance 196 from the fuel nozzle centerline axis 108, and the second circumferential row 194 of the purge orifices 132*a* is arranged a second radial distance 198 greater than the first radial distance 196 from the fuel nozzle centerline axis 108. The purge orifices 132*a* in the first circumferential row 192 are circumferentially spaced apart from each other by an angular spacing 200, and the purge orifices 132*a* in the second circumferential row 194 are circumferentially spaced apart from each other by an angular spacing 202. In addition, the purge orifices 132*a* in the first circumferential row 192 may be angularly staggered from the purge orifices 132*a* in the second circumferential row 194 by an angular offset spacing 204. In FIG. 7, the plurality of purge orifices 132*a* in the first circumferential row 192 are shown to be circular-shaped purge orifices 206, while the plurality of purge orifices 132*a* in the second circumferential row 194 are shown to be oval-shaped purge orifices 208, similar to the oval-shaped purge orifices 160 (FIG. 4). A center 209 of each of the circular-shaped purge orifices 206 is aligned in the first circumferential row 192 the first radial distance 196 from the fuel nozzle centerline axis 108, and a centroid 211 of each of the oval-shaped purge orifices 208 is aligned in the second circumferential row 194 the second radial distance 198 from the fuel nozzle centerline axis 108.

Figure 8:
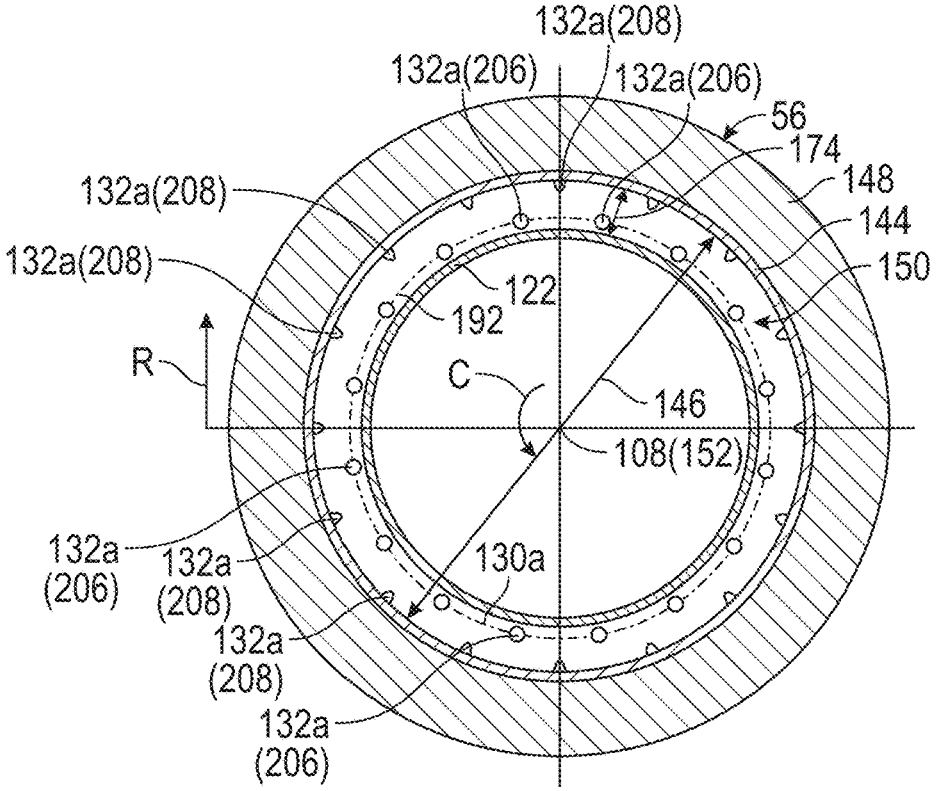
FIG. 8 depicts an alternate forward-looking cross-sectional view to that of FIG. 5 of the alternate mounting wall and the dome-deflector structure in the first state, according to an aspect of the present disclosure.

FIG. 8 depicts an alternate forward-looking cross-sectional view to that of FIG. 5 of the alternate mounting wall 130*a* and the dome-deflector structure 56, according to an aspect of the present disclosure. In FIG. 8, elements that are the same as those in FIG. 5 include the same reference numerals and the description provided above for FIG. 5 of those elements is also applicable to FIG. 8, unless stated otherwise. In the same manner as described above for FIG. 5, FIG. 8 depicts the radial relationship in the first state in which the fuel nozzle centerline axis 108 and the opening centerline axis 152 of the fuel nozzle-swirler assembly opening 146 are congruent with each other such that the circumferential purge cavity 150 has the constant radial height 174. In the FIG. 8 aspect, the dome-deflector structure 56 overlaps at portion of each of the oval-shaped purge orifices 208 in the second circumferential row 194 (FIG. 7), while each of the circular-shaped purge orifices 206 remains unblocked to allow the purge airflow 82*c* to pass therethrough into the circumferential purge cavity 150. The size (e.g., diameter) of each of the circular-shaped purge orifices 206, as well as the number of the circular-shaped purge orifices 206 included through the mounting wall 130*a*, along with the unblocked effective flow area of the overlapped oval-shaped purge orifices 208, is designed to provide the sufficient total purge airflow 82*c* to the circumferential purge cavity 150 in the first state so as to prevent the ingestion of the hot combustion gases 86 into the circumferential purge cavity 150.

Figure 9:
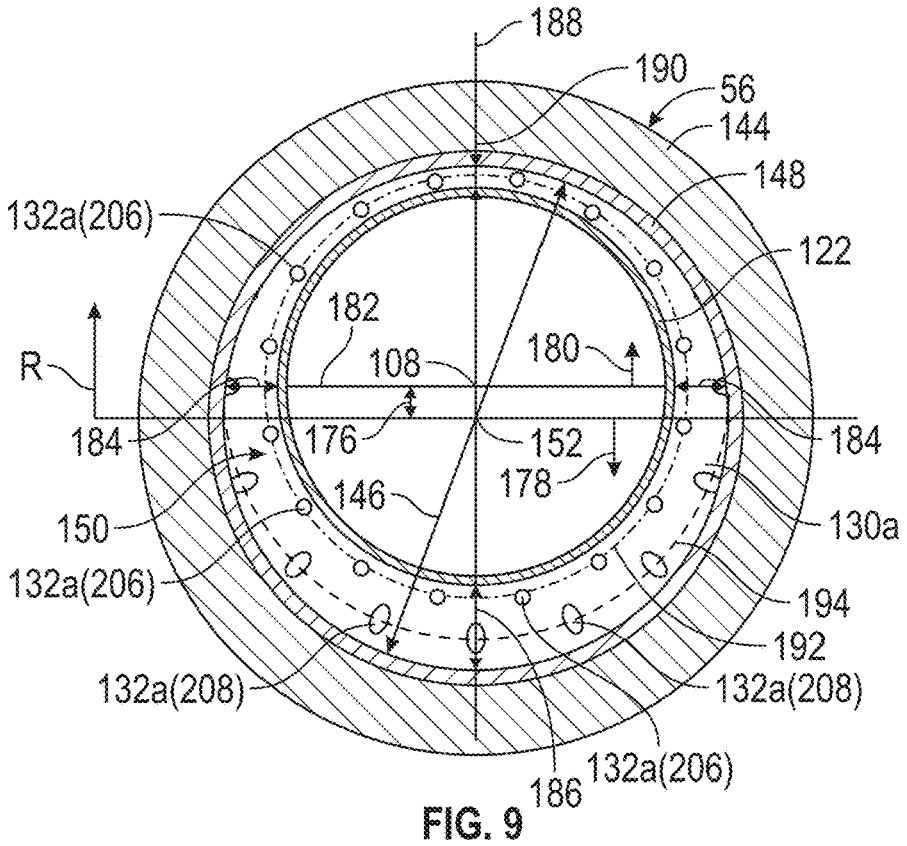
FIG. 9 depicts an alternate forward-looking cross-sectional view to that of FIG. 6 of the alternate mounting wall and the dome-deflector structure in the second state, according to an aspect of the present disclosure.

FIG. 9 depicts an alternate forward-looking cross-sectional view to that of FIG. 6 of the alternate mounting wall 130*a* and the dome-deflector structure 56 in the second state, according to an aspect of the present disclosure. In FIG. 9, elements that are the same as those in FIG. 6 include the same reference numerals and the description provided above for FIG. 6 of those elements is also applicable to FIG. 9, unless stated otherwise. In FIG. 9, in the same manner described above for FIG. 6, the fuel nozzle-swirler assembly 58 is shown in the second state as being shifted in the radial direction (R) by the radial shift distance 176. As a result, in the same manner described above for the FIG. 6 aspect, the radial height 174 of the circumferential purge cavity 150 increases on the first side 178 to be between the radial height 184 and the radial height 186. The radial height 174 of the circumferential purge cavity 150 decreases on the second side 180 to be between the radial height 184 and the radial height 190. Thus, as shown in FIG. 9, in the second state, the dome-deflector structure 56 decreases the blockage of oval-shaped purge orifices 208 in the second circumferential row 194 on the first side 178 of the circumferential purge cavity 150, and increases the blockage of the oval-shaped purge orifices 208 in the second circumferential row 194 on the second side 180 opposing the first side 178 of the circumferential purge cavity 150. The circular-shaped purge orifices 206 remain unblocked in both the first state and in the second state, and can provide the purge airflow 82*c* therethrough in both states. In the same manner described above for FIG. 6, the total purge airflow amount through the purge orifices 132*a* in the first state and in the second state remains constant due to a corresponding effective flow area unblocking of some of the purge orifices 132*a* with an increased blocking of some of the other purge orifices 132*a*. Thus, although a larger radial height 186 may be present on the first side 178 of the circumferential purge cavity 150, the increased purge airflow on the first side 178 can counter the increased radial height 186 so as to prevent the ingestion of the hot combustion gases 86 into the circumferential purge cavity 150.

Figure 10:
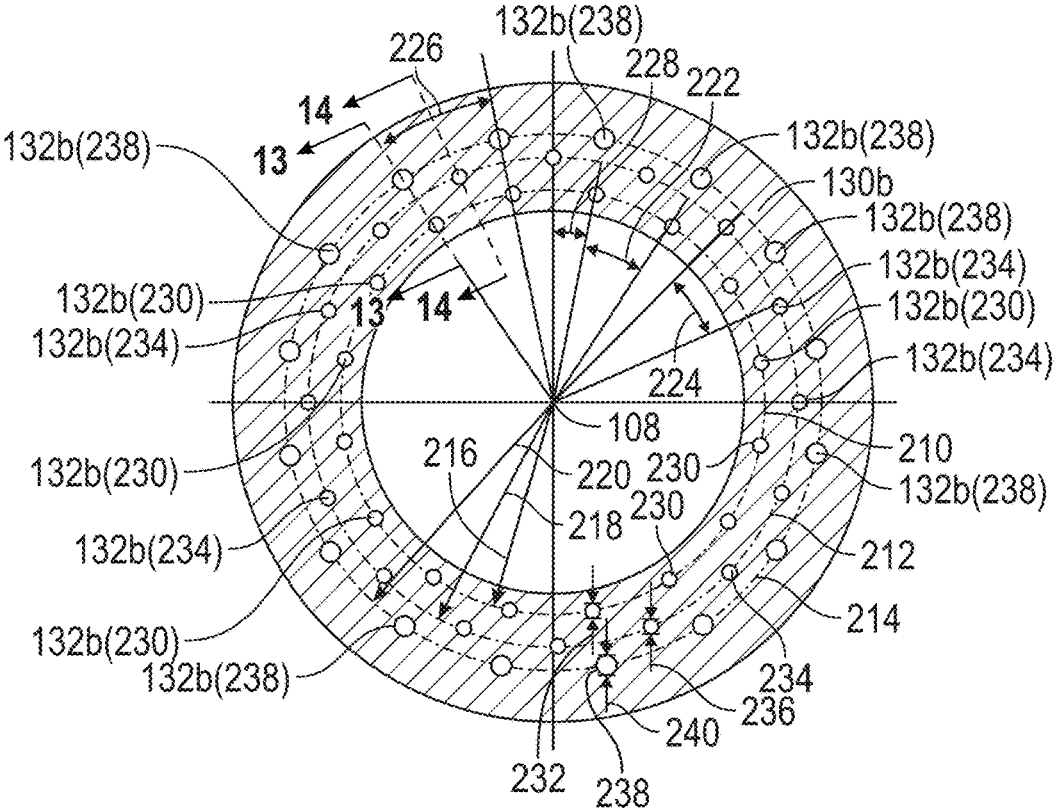
FIG. 10 depicts an alternate cross-sectional view of a fuel nozzle-swirler assembly mounting wall and purge orifices to that shown in FIG. 7, according to an aspect of the present disclosure.

FIG. 10 depicts an alternate cross-sectional view of fuel nozzle-swirler assembly mounting wall 130*b* and purge orifices 132*b* to that shown in FIG. 7, according to an aspect of the present disclosure. Elements in FIG. 10 that are the same as those of FIG. 7 are labeled with the same reference numerals and the description above for those elements is also applicable to FIG. 10, unless stated otherwise. In FIG. 10, the plurality of purge orifices 132*b* are seen to be arranged in a plurality of circumferential rows, including a first circumferential row 210 of purge orifices 132*b*, a second circumferential row 212 of purge orifices 132*b*, and a third circumferential row 214 of purge orifices 132*b*. The first circumferential row 210 of the purge orifices 132*b* is arranged a first radial distance 216 from the fuel nozzle centerline axis 108, the second circumferential row 212 of the purge orifices 132*b* is arranged a second radial distance 218 greater than the first radial distance 216 from the fuel nozzle centerline axis 108, and the third circumferential row 214 of the purge orifices 132*b* is arranged a third radial distance 220 greater than the second radial distance 218 from the fuel nozzle centerline axis 108. The purge orifices 132*b* in the first circumferential row 210 are circumferentially spaced apart from each other by an angular spacing 222. The purge orifices 132*b* in the second circumferential row 212 are circumferentially spaced apart from each other by an angular spacing 224. The purge orifices 132*b* in the third circumferential row 214 are circumferentially spaced apart from each other by an angular amount 226. In addition, the purge orifices 132*b* in the first circumferential row 210 may be angularly staggered from the purge orifices 132*b* in the second circumferential row 212 and from the purge orifices 132*b* in the third circumferential row 214 by an angular offset spacing 228. In FIG. 10, the plurality of purge orifices 132*b* in the first circumferential row 210 are shown be circular-shaped purge orifices 230 that may have a first diameter 232. The plurality of purge orifices 132*b* in the second circumferential row 212 are shown to be circular-shaped purge orifices 234 that may have a second diameter 236. The plurality of purge orifices 132*b* in the third circumferential row 214 are shown to be circular-shaped purge orifices 238 that may have a third diameter 240. The first diameter 232, the second diameter 236, and the third diameter 240 may be the same diameter, or may each be different from one another. For example, as shown in FIG. 10, the first diameter 232 of the circular-shape purge orifices 230 in the first circumferential row 210 and the second diameter 236 of the circular-shaped purge orifices 234 in the second circumferential row 212 may be the same, while the third diameter 240 of the circular-shaped purge orifices 238 in the third circumferential row 214 may be greater than the first diameter 232 and the second diameter 236.

Figure 11:
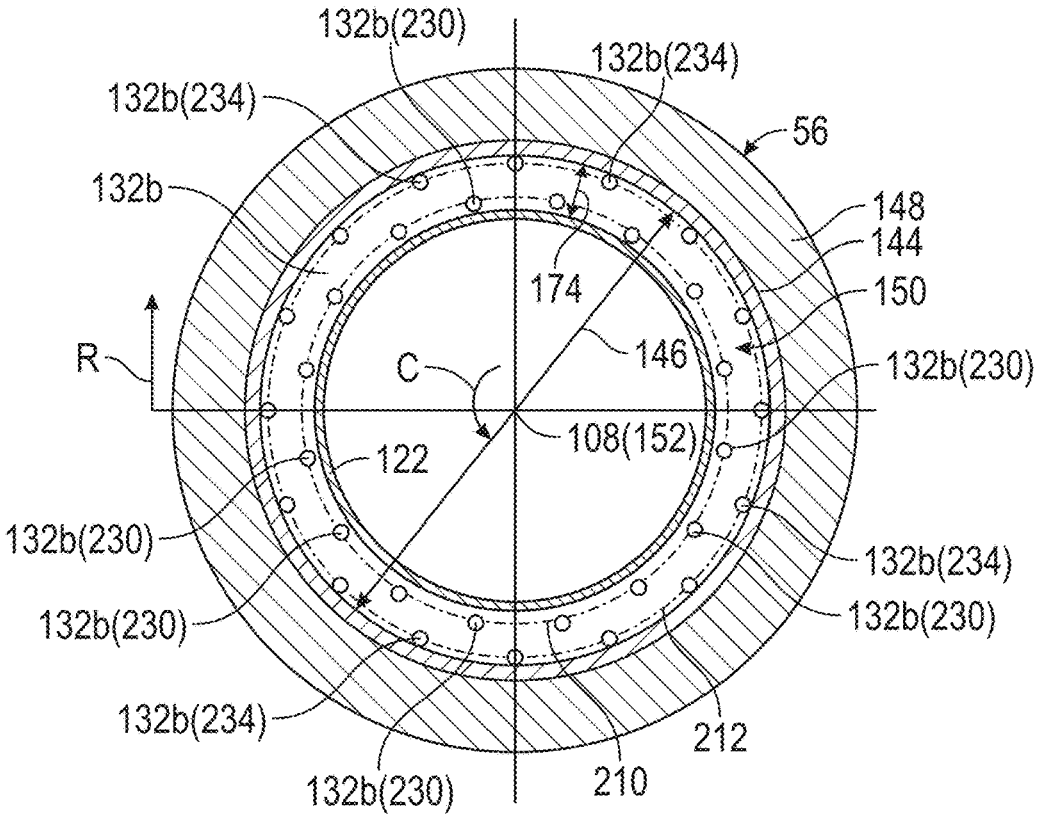
FIG. 11 depicts an alternate forward-looking cross-sectional view to that of FIG. 8 of the alternate mounting wall and the dome-deflector structure in the first state, according to an aspect of the present disclosure.

FIG. 11 depicts an alternate forward-looking cross-sectional view to that of FIG. 8 of the alternate mounting wall 130*b* and the dome-deflector structure 56 in the first state, according to an aspect of the present disclosure. In FIG. 11, elements that are the same as those in FIG. 8 include the same reference numerals and the description provided above for FIG. 8 of those elements is also applicable to FIG. 11, unless stated otherwise. In the same manner as described above for FIG. 8, FIG. 11 depicts the radial relationship in the first state in which the fuel nozzle centerline axis 108 and the opening centerline axis 152 of the fuel nozzle-swirler assembly opening 146 are congruent with each other such that the circumferential purge cavity 150 has the constant radial height 174. In the FIG. 11 aspect, the dome-deflector structure 56 overlaps each of the circular-shaped purge orifices 238 (FIG. 10) in the third circumferential row 214 in the first state, while each of the circular-shaped purge orifices 230 in the first circumferential row 210 and each of the circular-shaped purge orifices 234 in the second circumferential row 212 remain unblocked to allow the purge airflow 82*c* (FIG. 3) to pass therethrough into the circumferential purge cavity 150. The size (e.g., diameter) of each of the circular-shaped purge orifices 230 and the circular-shaped purge orifices 234, as well as the number of the circular-shaped purge orifices 230 and the circular-shaped purge orifices 234 included through the mounting wall 130*b* is designed to provide the sufficient total purge airflow 82*c* to the circumferential purge cavity 150 in the first state so as to prevent the ingestion of the hot combustion gases 86 into the circumferential purge cavity 150.

Figure 12:
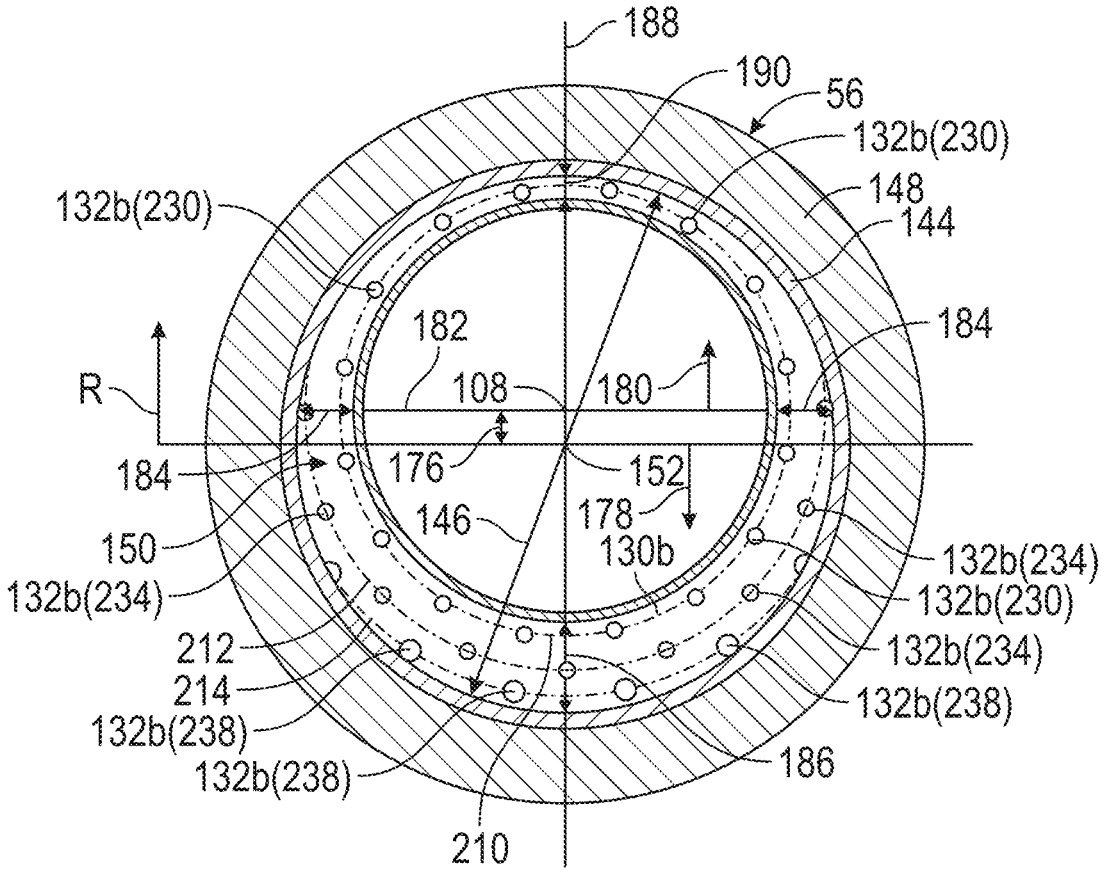
FIG. 12 depicts an alternate forward-looking cross-sectional view to that of FIG. 9 of the alternate mounting wall and the dome-deflector structure in the second state, according to an aspect of the present disclosure.

FIG. 12 depicts an alternate forward-looking cross-sectional view to that of FIG. 9 of the alternate mounting wall 130*b* and the dome-deflector structure 56 in the second state, according to an aspect of the present disclosure. In FIG. 12, elements that are the same as those in FIG. 9 include the same reference numerals and the description provided above for FIG. 9 of those elements is also applicable to FIG. 12, unless stated otherwise. In FIG. 12, in the same manner described above for FIG. 9, the fuel nozzle-swirler assembly 58 (FIG. 3) is shown in the second state as being shifted in the radial direction (R) by the radial shift distance 176. As a result, in the same manner described above for the FIG. 9 aspect, the radial height 174 of the circumferential purge cavity 150 increases on the first side 178 to be between the radial height 184 and the radial height 186. The radial height 174 of the circumferential purge cavity 150 decreases on the second side 180 to be between the radial height 184 and the radial height 190. Thus, as shown in FIG. 12, in the second state, the dome-deflector structure 56 decreases the blockage of circular-shaped purge orifices 238 in the third circumferential row 214 on the first side 178 of the circumferential purge cavity 150, and continues to block the circular-shaped purge orifices 230 in the third circumferential row 214 on the second side 180, while also blocking at least a portion of the circular-shaped purge orifices 234 in the second circumferential row 212 on the second side 180. The circular-shaped purge orifices 230 in the first circumferential row 210 remain unblocked in both the first state and in the second state and can provide the purge airflow 82*c* therethrough in both states. In the same manner described above for FIG. 9, the total purge airflow volume through the purge orifices 132*b* in the first state and in the second state remains constant due to a corresponding effective flow area unblocking of some of the purge orifices 132*b* with an increased blocking of some of the other purge orifices 132*b*. Thus, although a larger radial height 186 may be present on the first side 178 of the circumferential purge cavity 150, the increased purge airflow on the first side 178 can counter the increased radial height 186 so as to prevent the ingestion of the hot combustion gases 86 into the circumferential purge cavity 150.

Figure 13:
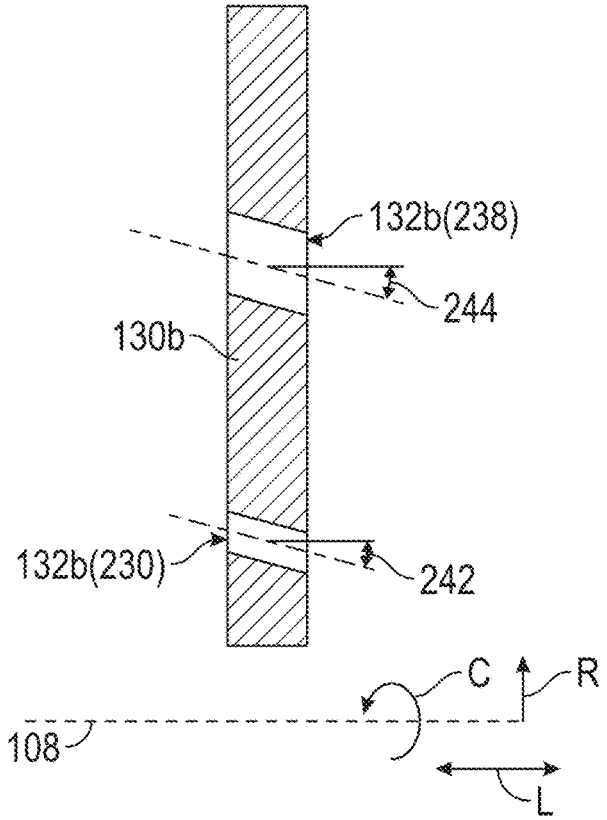
FIG. 13 is a cross-sectional view through the mounting wall of FIG. 10, taken at plane 13-13 in FIG. 10, according to an aspect of the present disclosure.

FIG. 13 is a cross-sectional view through the mounting wall 130*b* of FIG. 10, taken at plane 13-13 in FIG. 10, according to an aspect of the present disclosure. As shown in FIG. 13, as least one of the circular-shaped purge orifices 230 may be arranged at a first angle 242 with respect to the fuel nozzle centerline axis 108, and at least one of the circular-shaped purge orifices 238 may be arranged at a second angle 244 with respect to the fuel nozzle centerline axis 108. The first angle 242 and the second angle 244 may be the same, or may be different from one another. As some examples, the first angle 242 and the second angle 244 may range from thirty degrees to sixty degrees. The first angle 242 and the second angle 244 direct the flow toward the radially inward side of the circumferential purge cavity 150 to prevent hot gas ingestion from occurring along the main swirler housing 122, thereby providing better protection of the main swirler housing 122. In addition, while both the first angle 242 and the second angle 244 are shown in FIG. 13 as being directed toward the fuel nozzle centerline axis 108, either one of the first angle 242 or the second angle 244 may be directed away from the fuel nozzle centerline axis 108 instead. Either one or both of the first angle 242 or the second angle 244 has an axial component extending longitudinally with respect to the fuel nozzle centerline axis 108, and a radial component extending orthogonal to the longitudinal direction (L). However, either one of or both of the first angle 242 or the second angle 244 may also have a tangential component that extends in the circumferential direction (C) with respect to the fuel nozzle centerline axis 108. The inclusion of a tangential component can provide the purge airflow 82*c* in the same direction, or in an opposing direction, of a swirl direction of the main fuel-air mixture 61 exiting the annular cavity 124 of the main swirler housing 122 into the combustion chamber 62.

Figure 14:
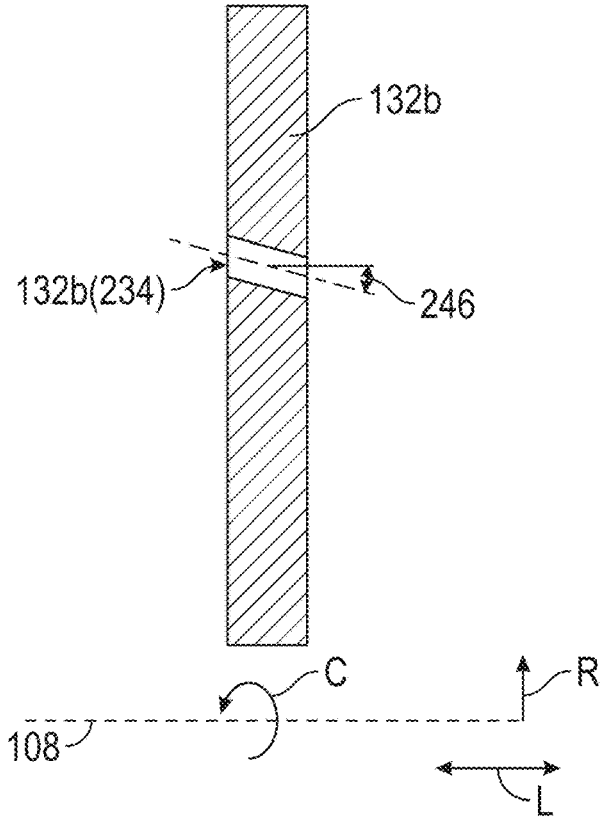
FIG. 14 is a cross-sectional view through the mounting wall of FIG. 10, taken at plane 14-14 in FIG. 10, according to an aspect of the present disclosure.

FIG. 14 is a cross-sectional view through the mounting wall 130*b* of FIG. 10, taken at plane 14-14 in FIG. 10, according to an aspect of the present disclosure. As shown in FIG. 14, as least one of the circular-shaped purge orifices 234 may be arranged at a third angle 246 with respect to the fuel nozzle centerline axis 108. The third angle 246 may be the same as, or may be different from either of the first angle 242 (FIG. 13) or the second angle 244 (FIG. 13). In addition, while the third angle 246 is shown as being directed toward the fuel nozzle centerline axis 108, the third angle 246 may be directed away from the fuel nozzle centerline axis 108 instead. The third angle 246 has an axial component extending longitudinally with respect to the fuel nozzle centerline axis 108, and a radial component extending orthogonal to the longitudinal direction (L). However, the third angle 246 may also have a tangential component that extends in the circumferential direction (C) with respect to the fuel nozzle centerline axis 108.

Figure 15C:
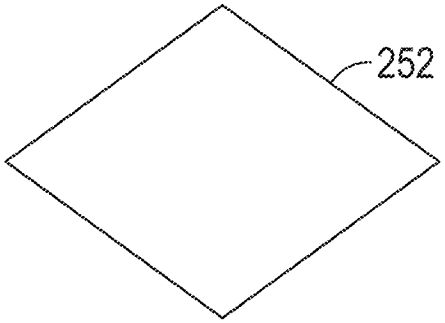
FIG. 15C depicts an example of a diamond-shaped purge orifice, according to an aspect of the present disclosure.
Figure 15B:
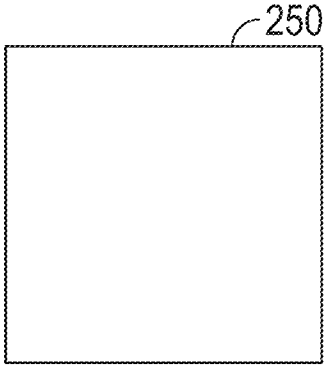
FIG. 15B depicts an example of a rectangular-shaped purge orifice, according to an aspect of the present disclosure.
Figure 15A:
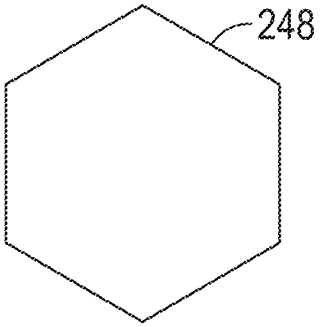
FIG. 15A depicts an example of a hexagonal-shaped purge orifice, according to an aspect of the present disclosure.
Figure 15F:
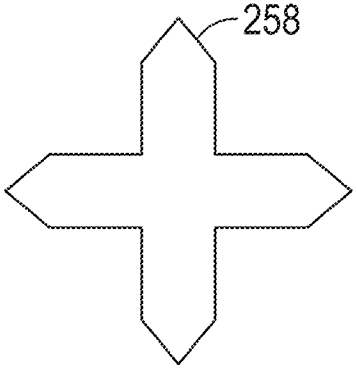
FIG. 15F depicts an example of a star-shaped purge orifice, according to an aspect of the present disclosure.
Figure 15E:
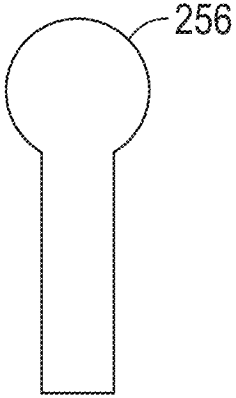
FIG. 15E depicts an example of a keyhole-shaped purge orifice, according to an aspect of the present disclosure.
Figure 15D:
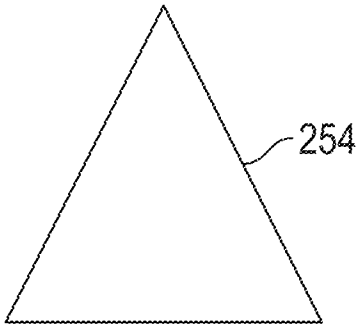
FIG. 15D depicts an example of a triangular-shaped purge orifice, according to an aspect of the present disclosure.

In the foregoing aspects, the purge orifices 132, the purge orifices 132*a*, and the purge orifices 132*b* were described as being either circular orifices or oval-shaped orifices. However, the purge orifices 132, the purge orifices 132*a*, and the purge orifices 132*b* are not limited to either of the foregoing shapes and other shapes may be implemented instead for the purge orifices. For example, FIG. 15A depicts an example of a hexagonal-shaped purge orifice 248 that may be implemented in the mounting wall 130 (FIG. 4), in the mounting wall 130*a* (FIG. 7), or in the mounting wall 130*b* (FIG. 10). FIG. 15B depicts an example of a rectangular-shaped purge orifice 250 that may be implemented in the mounting wall 130 (FIG. 4), in the mounting wall 130*a* (FIG. 7), or in the mounting wall 130*b* (FIG. 10). FIG. 15C depicts an example of a diamond-shaped purge orifice 252 that may be implemented in the mounting wall 130 (FIG. 4), in the mounting wall 130*a* (FIG. 7), or in the mounting wall 130*b* (FIG. 10). FIG. 15D depicts an example of a triangular-shaped purge orifice 254 that may be implemented in the mounting wall 130 (FIG. 4), in the mounting wall 130*a* (FIG. 7), or in the mounting wall 130*b* (FIG. 10). FIG. 15E depicts an example of a keyhole-shaped purge orifice 256 that may be implemented in the mounting wall 130 (FIG. 4), in the mounting wall 130*a* (FIG. 7), or in the mounting wall 130*b* (FIG. 10). FIG. 15F depicts an example of a star-shaped purge orifice 258 that may be implemented in the mounting wall 130 (FIG. 4), in the mounting wall 130*a* (FIG. 7), or in the mounting wall 130*b* (FIG. 10). The different shapes of the purge orifices 132 can provide a varying directional flow of the purge airflow 82*c* into the circumferential purge cavity 150 so as to provide different airflows for preventing the ingestion of the hot combustion gases into the circumferential purge cavity 150.

Each of the forgoing aspects provide the ability to circumferentially control the purge airflow 82*c* into the circumferential purge cavity 150 when the fuel nozzle-swirler assembly 58 shifts with respect to the dome-deflector structure 56 in operation of the gas turbine engine 10. As a result, hot combustion gases that may otherwise be ingested into the circumferential purge cavity 150 can be prevented from flowing to the circumferential purge cavity 150, thereby increasing the durability of the fuel nozzle-swirler assembly 58.

While the foregoing description relates generally to a gas turbine engine, the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A combustor for a gas turbine engine, the combustor including a dome-deflector structure having a fuel nozzle-swirler assembly opening therethrough, and a fuel nozzle-swirler assembly having (a) a housing and (b) a mounting wall extending from the housing, the mounting wall having a plurality of purge orifices extending therethrough and being circumferentially spaced apart from each other, wherein the fuel nozzle-swirler assembly is mounted to the dome-deflector structure to extend at least partially through the fuel nozzle-swirler assembly opening and a circumferential purge cavity is defined between the housing, the fuel nozzle-swirler assembly opening of the dome-deflector structure, and the mounting wall, and the plurality of purge orifices are arranged to provide a purge airflow to the circumferential purge cavity, in a first state, in which a radial height of the circumferential purge cavity is constant circumferentially, the dome-deflector structure overlaps a portion of each of the plurality of purge orifices so as to block a portion of each purge orifice, and in a second state, in which the fuel nozzle-swirler assembly is radially shifted such that a radial height of the circumferential purge cavity on a first side of the circumferential purge cavity is increased and a radial height of the circumferential purge cavity on a second side of the circumferential purge cavity opposing the first side is decreased, the dome-deflector structure increases blockage of at least one purge orifice on the second side, and the dome-deflector structure reduces blockage of at least one purge orifice on the first side.

The combustor according to the preceding clause, wherein a total purge airflow volume through the plurality of purge orifices in the first state and a total purge airflow volume through the plurality of purge orifices in the second state is constant.

The combustor according to any preceding clause, wherein at least one of the plurality of purge orifices is one of a circular orifice, an oval-shaped orifice, a hexagon-shaped orifice, a rectangular-shaped orifice, a triangular-shaped orifice, a diamond-shaped orifice, a keyhole-shaped orifice, or a star-shaped orifice.

The combustor according to any preceding clause, wherein the plurality of purge orifices are arranged at an angle with respect to a fuel nozzle centerline axis.

The combustor according to any preceding clause, wherein the fuel nozzle-swirler assembly opening defines an opening centerline axis therethrough, the fuel nozzle-swirler assembly defines a fuel nozzle centerline axis, in the first state, the opening centerline axis and the fuel nozzle centerline axis are congruent with each other, and, in the second state, the opening centerline axis and the fuel nozzle centerline axis are radially offset with respect to one another.

The combustor according to any preceding clause, wherein the mounting wall extends in a radial direction, with respect to the fuel nozzle centerline axis, from the housing and extends circumferentially about the fuel nozzle centerline axis.

The combustor according to any preceding clause, wherein the fuel nozzle-swirler assembly is mounted to the dome-deflector structure via a mounting member connected to the dome-deflector structure, and the mounting wall slidingly engages with the mounting member to allow radial motion of the fuel nozzle-swirler assembly with respect to the fuel nozzle-swirler assembly opening.

The combustor according to any preceding clause, wherein each of the plurality of purge orifices is an oval-shaped orifice with a major axis extending radially with respect to the fuel nozzle centerline axis.

The combustor according to any preceding clause, wherein, in the first state, the dome-deflector structure blocks a radially outward portion of each oval-shaped orifice.

The combustor according to any preceding clause, wherein the plurality of purge orifices are arranged in a plurality of circumferential rows, including a first circumferential row arranged at a first radial distance from the fuel nozzle centerline axis, and a second circumferential row arranged at a second radial distance greater than the first radial distance from the fuel nozzle centerline axis.

The combustor according to any preceding clause, wherein purge orifices in the first circumferential row are arranged at a first angle with respect to the fuel nozzle centerline axis, and purge orifices in the second circumferential row are arranged at a second angle different from the first angle with respect to the fuel nozzle centerline axis.

The combustor according to any preceding clause, wherein purge orifices in the first circumferential row are circumferentially staggered with respect to purge orifices in the second circumferential row.

The combustor according to any preceding clause, wherein the plurality of purge orifices are further arranged in a third circumferential row arranged at a third radial distance greater than the second radial distance from the fuel nozzle centerline axis.

The combustor according to any preceding clause, wherein, in the first state, the dome-deflector structure overlaps the entirety of each purge orifice in the third circumferential row, and, in the second state, at least one of the purge orifices in the third circumferential row on the first side is at least partially unblocked.

The combustor according to any preceding clause, wherein, in the first state, the dome-deflector structure blocks at least a portion of each of purge orifice in the second circumferential row.

The combustor according to any preceding clause, wherein purge orifices in the first circumferential row are circular-shaped purge orifices, and purge orifices in the second circumferential row are oval-shaped purge orifices.

The combustor according to any preceding clause, wherein, in the second state, the dome-deflector structure decreases the blockage of purge orifices in the second circumferential row on a first side of the circumferential purge cavity, and increases the blockage of purge orifices in the second circumferential row on a second side opposing the first side of the circumferential purge cavity.

A gas turbine engine including a compressor section, and a combustor arranged in fluid communication with the compressor section and arranged to receive a flow of compressed air from the compressor section, the combustor including a dome-deflector structure having a fuel nozzle-swirler assembly opening therethrough, and a fuel nozzle-swirler assembly having (a) a housing and (b) a mounting wall extending from the housing, the mounting wall having a plurality of purge orifices extending therethrough and being circumferentially spaced apart from each other, wherein the fuel nozzle-swirler assembly is mounted to the dome-deflector structure to extend at least partially through the fuel nozzle-swirler assembly opening and a circumferential purge cavity is defined between the housing, the fuel nozzle-swirler assembly opening of the dome-deflector structure, and the mounting wall, and the plurality of purge orifices are arranged to provide a purge airflow to the circumferential purge cavity, in a first state, in which a radial height of the circumferential purge cavity is constant circumferentially, the dome-deflector structure overlaps a portion of each of the plurality of purge orifices so as to block a portion of each purge orifice, and in a second state, in which the fuel nozzle-swirler assembly is radially shifted such that a radial height of the circumferential purge cavity on a first side of the circumferential purge cavity is increased and a radial height of the circumferential purge cavity on a second side of the circumferential purge cavity opposing the first side is decreased, the dome-deflector structure increases blockage of at least one purge orifice on the second side, and the dome-deflector structure reduces blockage of at least one purge orifice on the first side.

The gas turbine engine according to the preceding clause, wherein the fuel nozzle-swirler assembly opening defines an opening centerline axis therethrough, the fuel nozzle-swirler assembly defines a fuel nozzle centerline axis, in the first state, the opening centerline axis and the fuel nozzle centerline axis are congruent with each other, and, in the second state, the opening centerline axis and the fuel nozzle centerline axis are radially offset with respect to one another, the mounting wall extends in a radial direction, with respect to the fuel nozzle centerline axis, from the housing and extends circumferentially about the fuel nozzle centerline axis, and the fuel nozzle-swirler assembly is mounted to the dome-deflector structure via a mounting member connected to the dome-deflector structure, and the mounting wall slidingly engages with the mounting member to allow radial motion of the fuel nozzle-swirler assembly with respect to the fuel nozzle-swirler assembly opening.

The gas turbine engine according to any preceding clause, wherein each of the plurality of purge orifices is an oval-shaped orifice with a major axis extending radially with respect to the fuel nozzle centerline axis, and, in the first state, the dome-deflector structure blocks a radially outward portion of each oval-shaped orifice.

The gas turbine engine according to any preceding clause, wherein a total purge airflow volume through the plurality of purge orifices in the first state and a total purge airflow volume through the plurality of purge orifices in the second state is constant.

The gas turbine engine according to any preceding clause, wherein at least one of the plurality of purge orifices is one of a circular orifice, an oval-shaped orifice, a hexagon-shaped orifice, a rectangular-shaped orifice, a triangular-shaped orifice, a diamond-shaped orifice, a keyhole-shaped orifice, or a star-shaped orifice.

The gas turbine engine according to any preceding clause, wherein the plurality of purge orifices are arranged at an angle with respect to a fuel nozzle centerline axis.

The gas turbine engine according to any preceding clause, wherein the fuel nozzle-swirler assembly opening defines an opening centerline axis therethrough, the fuel nozzle-swirler assembly defines a fuel nozzle centerline axis, in the first state, the opening centerline axis and the fuel nozzle centerline axis are congruent with each other, and, in the second state, the opening centerline axis and the fuel nozzle centerline axis are radially offset with respect to one another.

The gas turbine engine according to any preceding clause, wherein the mounting wall extends in a radial direction, with respect to the fuel nozzle centerline axis, from the housing and extends circumferentially about the fuel nozzle centerline axis.

The gas turbine engine according to any preceding clause, wherein the fuel nozzle-swirler assembly is mounted to the dome-deflector structure via a mounting member connected to the dome-deflector structure, and the mounting wall slidingly engages with the mounting member to allow radial motion of the fuel nozzle-swirler assembly with respect to the fuel nozzle-swirler assembly opening.

The gas turbine engine according to any preceding clause, wherein each of the plurality of purge orifices is an oval-shaped orifice with a major axis extending radially with respect to the fuel nozzle centerline axis.

The gas turbine engine according to any preceding clause, wherein, in the first state, the dome-deflector structure blocks a radially outward portion of each oval-shaped orifice.

The gas turbine engine according to any preceding clause, wherein the plurality of purge orifices are arranged in a plurality of circumferential rows, including a first circumferential row arranged at a first radial distance from the fuel nozzle centerline axis, and a second circumferential row arranged at a second radial distance greater than the first radial distance from the fuel nozzle centerline axis.

The gas turbine engine according to any preceding clause, wherein purge orifices in the first circumferential row are arranged at a first angle with respect to the fuel nozzle centerline axis, and purge orifices in the second circumferential row are arranged at a second angle different from the first angle with respect to the fuel nozzle centerline axis.

The gas turbine engine according to any preceding clause, wherein purge orifices in the first circumferential row are circumferentially staggered with respect to purge orifices in the second circumferential row.

The gas turbine engine according to any preceding clause, wherein the plurality of purge orifices are further arranged in a third circumferential row arranged at a third radial distance greater than the second radial distance from the fuel nozzle centerline axis.

The gas turbine engine according to any preceding clause, wherein, in the first state, the dome-deflector structure overlaps the entirety of each purge orifice in the third circumferential row, and, in the second state, at least one of the purge orifices in the third circumferential row on the first side is at least partially unblocked.

The gas turbine engine according to any preceding clause, wherein, in the first state, the dome-deflector structure blocks at least a portion of each of purge orifice in the second circumferential row.

The gas turbine engine according to any preceding clause, wherein purge orifices in the first circumferential row are circular-shaped purge orifices, and purge orifices in the second circumferential row are oval-shaped purge orifices.

The gas turbine engine according to any preceding clause, wherein, in the second state, the dome-deflector structure decreases the blockage of purge orifices in the second circumferential row on a first side of the circumferential purge cavity, and increases the blockage of purge orifices in the second circumferential row on a second side opposing the first side of the circumferential purge cavity.

Although the foregoing description is directed to some exemplary embodiments of the present disclosure, other variations and modifications will be apparent to those skilled in the art, and may be made without departing from the present disclosure. Moreover, features described in connection with one embodiment of the present disclosure may be used in conjunction with other embodiments, even if not explicitly stated above.

We claim:

1. A combustor for a gas turbine engine, the combustor comprising:

a dome-deflector structure defining a fuel nozzle-swirler assembly opening therethrough; and a fuel nozzle-swirler assembly having (a) a housing and (b) a mounting wall extending from the housing, the mounting wall having a plurality of purge orifices extending therethrough and being circumferentially spaced apart from each other, wherein the fuel nozzle-swirler assembly is mounted to the dome-deflector structure to extend at least partially through the fuel nozzle-swirler assembly opening and a circumferential purge cavity is defined between the housing, the fuel nozzle-swirler assembly opening of the dome-deflector structure, and the mounting wall, and the plurality of purge orifices are arranged to provide a purge airflow to the circumferential purge cavity, in a first state, in which a radial height of the circumferential purge cavity is constant circumferentially, the dome-deflector structure overlaps a portion of each of the plurality of purge orifices so as to block a portion of each purge orifice, and in a second state, in which the fuel nozzle-swirler assembly is radially shifted such that a radial height of the circumferential purge cavity on a first side of the circumferential purge cavity is increased and a radial height of the circumferential purge cavity on a second side of the circumferential purge cavity opposing the first side is decreased, the dome-deflector structure increases blockage of at least one purge orifice on the second side, and the dome-deflector structure reduces blockage of at least one purge orifice on the first side.

2. The combustor according to claim 1, wherein a total purge airflow volume through the plurality of purge orifices in the first state and a total purge airflow volume through the plurality of purge orifices in the second state is constant.

3. The combustor according to claim 1, wherein at least one of the plurality of purge orifices is one of a circular orifice, an oval-shaped orifice, a hexagon-shaped orifice, a rectangular-shaped orifice, a triangular-shaped orifice, a diamond-shaped orifice, a keyhole-shaped orifice, or a star-shaped orifice.

4. The combustor according to claim 1, wherein the plurality of purge orifices are arranged at an angle with respect to a fuel nozzle centerline axis.

5. The combustor according to claim 1, wherein the fuel nozzle-swirler assembly opening defines an opening centerline axis therethrough, the fuel nozzle-swirler assembly defines a fuel nozzle centerline axis, in the first state, the opening centerline axis and the fuel nozzle centerline axis are congruent with each other, and, in the second state, the opening centerline axis and the fuel nozzle centerline axis are radially offset with respect to one another.

6. The combustor according to claim 5, wherein the mounting wall extends in a radial direction, with respect to the fuel nozzle centerline axis, from the housing and extends circumferentially about the fuel nozzle centerline axis.

7. The combustor according to claim 6, wherein the fuel nozzle-swirler assembly is mounted to the dome-deflector structure via a mounting member connected to the dome-deflector structure, and the mounting wall slidingly engages with the mounting member to allow radial motion of the fuel nozzle-swirler assembly with respect to the fuel nozzle-swirler assembly opening.

8. The combustor according to claim 5, wherein each of the plurality of purge orifices is an oval-shaped orifice with a major axis extending radially with respect to the fuel nozzle centerline axis.

9. The combustor according to claim 8, wherein, in the first state, the dome-deflector structure blocks a radially outward portion of each oval-shaped orifice.

10. The combustor according to claim 5, wherein the plurality of purge orifices are arranged in a plurality of circumferential rows, including a first circumferential row arranged at a first radial distance from the fuel nozzle centerline axis, and a second circumferential row arranged at a second radial distance greater than the first radial distance from the fuel nozzle centerline axis.

11. The combustor according to claim 10, wherein purge orifices in the first circumferential row are arranged at a first angle with respect to the fuel nozzle centerline axis, and purge orifices in the second circumferential row are arranged at a second angle different from the first angle with respect to the fuel nozzle centerline axis.

12. The combustor according to claim 10, wherein purge orifices in the first circumferential row are circumferentially staggered with respect to purge orifices in the second circumferential row.

13. The combustor according to claim 10, wherein the plurality of purge orifices are further arranged in a third circumferential row arranged at a third radial distance greater than the second radial distance from the fuel nozzle centerline axis.

14. The combustor according to claim 13, wherein, in the first state, the dome-deflector structure overlaps an entirety of each purge orifice in the third circumferential row, and, in the second state, at least one of the purge orifices in the third circumferential row on the first side is at least partially unblocked.

15. The combustor according to claim 10, wherein, in the first state, the dome-deflector structure blocks at least a portion of each of purge orifice in the second circumferential row.

16. The combustor according to claim 15, wherein purge orifices in the first circumferential row are circular-shaped purge orifices, and purge orifices in the second circumferential row are oval-shaped purge orifices.

17. The combustor according to claim 15, wherein, in the second state, the dome-deflector structure decreases a blockage of purge orifices in the second circumferential row on a first side of the circumferential purge cavity, and increases the blockage of purge orifices in the second circumferential row on a second side opposing the first side of the circumferential purge cavity.

18. A gas turbine engine, comprising:

a compressor section; and a combustor arranged in fluid communication with the compressor section and arranged to receive a flow of compressed air from the compressor section, the combustor including:

a dome-deflector structure defining a fuel nozzle-swirler assembly opening therethrough; and a fuel nozzle-swirler assembly having (a) a housing and (b) a mounting wall extending from the housing, the mounting wall having a plurality of purge orifices extending therethrough and being circumferentially spaced apart from each other, wherein the fuel nozzle-swirler assembly is mounted to the dome-deflector structure to extend at least partially through the fuel nozzle-swirler assembly opening and a circumferential purge cavity is defined between the housing, the fuel nozzle-swirler assembly opening of the dome-deflector structure, and the mounting wall, and the plurality of purge orifices are arranged to provide a purge airflow to the circumferential purge cavity, in a first state, in which a radial height of the circumferential purge cavity is constant circumferentially, the dome-deflector structure overlaps a portion of each of the plurality of purge orifices so as to block a portion of each purge orifice, and in a second state, in which the fuel nozzle-swirler assembly is radially shifted such that a radial height of the circumferential purge cavity on a first side of the circumferential purge cavity is increased and a radial height of the circumferential purge cavity on a second side of the circumferential purge cavity opposing the first side is decreased, the dome-deflector structure increases blockage of at least one purge orifice on the second side, and the dome-deflector structure reduces blockage of at least one purge orifice on the first side.

19. The gas turbine engine according to claim 18, wherein the fuel nozzle-swirler assembly opening defines an opening centerline axis therethrough, the fuel nozzle-swirler assembly defines a fuel nozzle centerline axis, in the first state, the opening centerline axis and the fuel nozzle centerline axis are congruent with each other, and, in the second state, the opening centerline axis and the fuel nozzle centerline axis are radially offset with respect to one another, the mounting wall extends in a radial direction, with respect to the fuel nozzle centerline axis, from the housing and extends circumferentially about the fuel nozzle centerline axis, and the fuel nozzle-swirler assembly is mounted to the dome-deflector structure via a mounting member connected to the dome-deflector structure, and the mounting wall slidingly engages with the mounting member to allow radial motion of the fuel nozzle-swirler assembly with respect to the fuel nozzle-swirler assembly opening.

20. The gas turbine engine according to claim 19, wherein each of the plurality of purge orifices is an oval-shaped orifice with a major axis extending radially with respect to the fuel nozzle centerline axis, and, in the first state, the dome-deflector structure blocks a radially outward portion of each oval-shaped orifice.

* * * * *